US005380625A

United States Patent [19]

Mihayashi et al.

[11] Patent Number: 5,380,625

[45] Date of Patent: Jan. 10, 1995

[54] METHOD FOR PROCESSING SILVER HALIDE COLOR PHOTOGRAPHIC MATERIALS COMPRISING PARTICULAR DYE COUPLERS USING PARTICULAR DEVELOPERS

[75] Inventors: Keiji Mihayashi; Masato Taniguchi; Naoki Saito, all of Kanagawa, Japan

[73] Assignee: Fuji Photo Film Co., Ltd., Kanagawa, Japan

[21] Appl. No.: 14,241

[22] Filed: Feb. 5, 1993

[30] Foreign Application Priority Data

Feb. 5, 1992 [JP] Japan ..... 4-047728

[51] Int. Cl.[6] ..... G03C 7/46; G03C 5/18; G03C 5/26

[52] U.S. Cl. ..... 430/388; 430/389; 430/384; 430/385; 430/442; 430/489; 430/485; 430/472; 430/475

[58] Field of Search ..... 430/380, 435, 442, 467, 430/484, 485, 384, 385, 473, 552, 553, 388, 389, 472, 475, 556, 557

[56] References Cited

U.S. PATENT DOCUMENTS

| | | | |
|---|---|---|---|
| 2,108,243 | 2/1938 | Wendt | 95/88 |
| 3,705,035 | 12/1972 | Vetter et al. | 430/380 |
| 3,920,739 | 11/1975 | Suda et al. | 430/484 |
| 4,149,886 | 4/1979 | Tanaka et al. | 430/389 |
| 4,857,442 | 8/1989 | Fujita et al. | 430/385 |
| 5,176,987 | 1/1993 | Nakamura et al. | 430/467 |
| 5,187,055 | 2/1993 | Kobayashi et al. | 430/557 |
| 5,194,369 | 3/1993 | Mihayashi et al. | 430/557 |
| 5,212,052 | 5/1993 | Sakanoue et al. | 430/557 |
| 5,238,803 | 8/1993 | Ichijima et al. | 430/556 |

FOREIGN PATENT DOCUMENTS

| | | | |
|---|---|---|---|
| 0410450 | 1/1991 | European Pat. Off. . | |
| 0447920 | 9/1991 | European Pat. Off. . | |
| 0482552 | 4/1992 | European Pat. Off. . | |
| 4011255 | 1/1992 | Japan | 430/467 |
| 807899 | 1/1959 | United Kingdom . | |

*Primary Examiner*—Charles L. Bowers, Jr.

*Assistant Examiner*—J. Pasterczyk

*Attorney, Agent, or Firm*—Sughrue, Mion, Zinn, Macpeak & Seas

[57] ABSTRACT

A method for processing a silver halide color photographic material, which comprises processing an imagewise exposed silver halide color photographic material comprising at least one silver halide emulsion layer and containing an N,N-substituted malondiamide type coupler with a color developer containing an aromatic primary amine color developing agent represented by the following general formula (D) or (E):

(D)

(E)

In a preferred embodiment, the photographic light-sensitive material contains a cyan coupler represented by the following general formula (C):

(C)

13 Claims, No Drawings

METHOD FOR PROCESSING SILVER HALIDE COLOR PHOTOGRAPHIC MATERIALS COMPRISING PARTICULAR DYE COUPLERS USING PARTICULAR DEVELOPERS

FIELD OF THE INVENTION

The present invention relates to a method for the processing of a silver halide color photographic material provides a reduction in color development time, a stable color development and improvements in the fastness colored image fastness, particularly in color reproducibility.

BACKGROUND OF THE INVENTION

Acylacetamide type couplers represented by benzoylacetanilide and pivaloylacetanilide couplers have been commonly used as yellow couplers for the formation of color photographic images. The former type of couplers normally exhibit a high activity on coupling with the oxidation product of an aromatic primary amine developing agent upon development, and the yellow dyes produced therefrom exhibit a slightly greater molecular extinction coefficient than that produced from the Latter type of couplers. Thus, the former type of couplers are used mainly for color photographic material for picture taking, which require a high sensitivity. On the other hand, the latter type of couplers have superior spectral absorption characteristics and the fastness of the yellow dyes produced therefrom is better than the former type of couplers. Thus, the latter couplers are used mainly for color papers and color reversal systems.

Couplers having a high coupling reactivity which produce dyes having a high molecular extinction coefficient can provide a high sensitivity, a high gradation and a high color density, giving a high so-called color developability. The term "yellow image with excellent spectral absorption characteristics" as used herein means a "yellow image with a low absorption density on the long wavelength side and hence little undesirable absorption in the green light range".

It has thus been desired to develop a yellow coupler which can form a dye with a high molecular extinction coefficient that gives a high color density, excellent spectral absorption characteristics and an excellent colored image fastness.

With reference to N,N-substituted malondiamide type yellow couplers of the present invention, French Patent 1,558,452 describes so-called o-release type yellow couplers containing a release group at the coupling active position via an oxygen atom, most of which are diffusable.

Further, European Patent Disclosure No. 447,920A describes partial yellow couplers as exemplary compounds.

Moreover, of the N,N'-substituted malondiamide type couplers, functional couplers are disclosed as couplers which release a development-inhibiting compound in JP-A-52-69624, JP-A-52-82424, JP-A-57-151944, and JP-A-2-250053 (the term "JP-A" as used herein means an "unexamined published Japanese patent application"), and the above cited European Patent Disclosure No. 447,920A. However, JP-A-52-82424 and JP-A-57-151944 do not disclose specific examples of such compounds, and JP-A-52-69624 contains no description of specific examples of effects achieved.

Of the couplers disclosed in these patents, some provide improvements in color developability, colored image fastness and color reproducibility. However, most of them still leave much to be desired. Further, the development-inhibiting compound-releasing type couplers leave much to be desired in image quality improvement effect.

On the other hand, the use of paraphenylenediamine, particularly N,N-dialkyl-substituted paraphenylenediamine compounds has often been proposed as color developing agents to be incorporated in color developers. For example, with reference to the modification of alkyl group substituted in the N-position, an N-hydroxyalkyl group is described in U.S. Pat. No. 2,108,243, British Patent 807,899, and European Patent 410,450A2, an N-sulfonamidoalkyl group is described in U.S. Pat. Nos. 2,193,015, 2,552,240, and 2,566,271, an N-carbamoylalkyl group is described in U.S. Pat. No. 2,374,337, and JP-A-3-246542 and JP-A-3-246543, an N-sulfamoyl group is described in U.S. Pat. No. 2,193,015, an N-acylaminoalkyl group is described in U.S. Pat. Nos. 2,552,242, and 2,592,363, an N-quaternary ammonium alkyl group is described in British Patent 539,937, a nucleated N-alkyl group containing a phosphorus atom as a substituent on the alkyl group is described in British Patent 539,395, an N-acylalkyl group is described in U.S. Pat. No. 2,374,337, an N-alkoxyalkyl group is described in U.S. Pat. No. 2,603,656, JP-A-47-11534, and JP-A-47-11535, and JP-B-54-16860, JP-B-58-14670, and JP-B-58-23618 (the term "JP-B" as used herein means an "examined Japanese patent publication"), an N-sulfoalkyl group is described in British Patent 811,679, and an N-aralkyl group is described in U.S. Pat. No. 2,716,132. Further, with reference to the modification of the substituent for the benzene nucleus, a nucleated alkoxy group is described in U.S. Pat. Nos. 2,304,953, 2,548,574, 2,552,240, and 2,592,364, a nucleated acylaminosulfonamide group is described in U.S. Pat. Nos. 2,350,109, and 2,449,919, a nucleated acylaminoalkyl sulfonamidoalkyl group is described in U.S. Pat. Nos. 2,552,241, 2,556,271, and 2,592,364, a nucleated amino group is described in U.S. Pat. Nos. 2,570,116, 2,575,027, and 2,652,331, and a nucleated thiosulfonic group is described in British Patent 872,683. Moreover, with reference to the use of analogous paraphenylenediamine compounds as color developing agents, tetrahydroquinoline and dihydroindole compounds are described in U.S. Pat. Nos. 2,196,739, and 2,566,259, N-(p-aminophenyl)hexamethyleneimine compounds are described in U.S. Pat. No. 2,612,500, and 9-aminojulolidine compounds are described in U.S. Pat. No. 2,707,681.

However, none of these color developing agents have been found to meet all requirements such as development activity, stability, image quality, e.g., fastness, graininess, sharpness and spectral absorption characteristics of color images formed on a color photographic light-sensitive material with these color developing agents, and stable color development.

European Patent Disclosure No. 410,450 describes some of color developing agents of the present invention. However, the above cited European patent can be applied to a silver halide color photographic material comprising a silver halide emulsion substantially free of silver iodide and containing 80 mol % or more of silver chloride but has no description of application to a silver halide emulsion with a high silver bromide or silver iodide content. Thus, the effects of these color developing agents on such a silver halide emulsion cannot be predicted from the above cited European patent. Further, the effects of N,N-substituted malondiamide type couplers cannot be fully predicted from the above cited European patent. Moreover, JP-A-4-11255 discloses some of color developing agents of the present invention but has no description of improvements in image quality by the use of N,N-substituted malondiamide type couplers. Thus, the effects of N,N-substituted malondiamide type couplers cannot be predicted from the above cited Japanese patent application disclosures.

As previously described, it has been desired to provide a stable color development process which provides further improvements in color developability, dye fastness and image quality when N,N-substituted malondiamide type yellow couplers are used and a further enhancement of the image quality improving effect when these N,N-substituted malondiamide type yellow couplers are development inhibitor-releasing type couplers.

SUMMARY OF THE INVENTION

It is therefore an object of the present invention to provide a method for processing a silver halide color photographic material which provides a further enhancement of color developability, colored image fastness, and particularly color reproducibility of N,N-substituted malondiamide type yellow couplers and enables a reduction in the color development time to effect a rapid processing with stability against fluctuations of the composition of the color developer.

This and other objects of the present invention will become more apparent from the following detailed description and examples.

The objects of the present invention are accomplished by a method for processing of a silver halide color photographic material, which comprises processing of a silver halide color photographic material comprising at least one silver halide emulsion layer and containing an N,N-substituted malondiamide type coupler with a color developer containing an aromatic primary amine color developing agent represented by the following general formula (D) or (E):

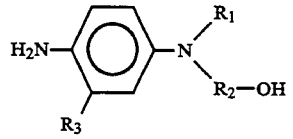

(D)

wherein $R_1$ represents a $C_{1-6}$ straight-chain or branched alkyl group or a $C_{3-6}$ straight-chain or branched hydroxyalkyl group; $R_2$ represents a $C_{3-6}$ straight-chain or branched alkylene group or a $C_{3-6}$ straight-chain or branched hydroxyalkylene group; and $R_3$ represents a hydrogen atom, a $C_{1-4}$ straight-chain or branched alkyl group or a $C_{1-4}$ straight-chain or branched alkoxy group;

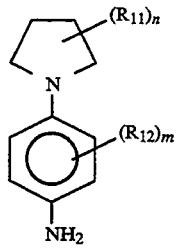

(E)

wherein $R_{11}$ represents a substituent; n represents 0 or an integer of 1 to 8, with the proviso that when n is 2 or more, the plurality of $(R_{11})$'s may be the same or different; and $R_{12}$ represents a substituent; m represents or an integer of 1 to 4, with the proviso that when m is 2 or more, the plurality of $(R_{12})$'s may be the same or different or may form a ring.

The objects of the present invention are also accomplished by a method for processing a silver halide color photographic material as defined above, which contains a cyan coupler represented by the following general formula (C):

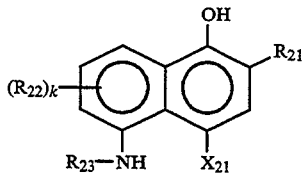

(C)

wherein $R_{21}$ represents $—CONR_{24}R_{25}$, $—SO_2NR_{24}R_{25}$, $—NHCOR_{24}$, $—NHCOOR_{26}$, $—NHSO_2R_{26}$, $—NHCONR_{24}R_{25}$ or $—NHSO_2NR_{24}R_{25}$ in which $R_{24}$ and $R_{25}$, which may be the same or different, each represents a hydrogen atom, an alkyl group, an aryl group or a heterocyclic group, and $R_{26}$ represents an alkyl group, an aryl group or a heterocyclic group; $R_{22}$ represents a group which can replace a hydrogen atom on the naphthalene ring; k represents 0 or an integer of 1 to 3; and $R_{23}$ represents a substituent; and $X_{21}$ represents a hydrogen atom or a group capable of being released upon coupling reaction with the oxidation product of an aromatic primary amine developing agent, with the proviso that when k is 2 or 3, the plurality of $(R_{22})$'s may be the same or different or may combine with each other to form a ring, and that $R_{22}$ and $R_{23}$ or $R_{23}$ and $X_{21}$ may combine to form a ring.

DETAILED DESCRIPTION OF THE INVENTION

N,N-substituted malondiamide type yellow couplers used in the present invention are further described hereinafter.

N,N-substituted malondiamide type yellow couplers are couplers represented by the following general formula (I):

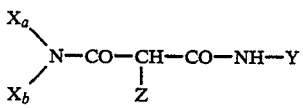

(I)

wherein $X_a$ and $X_b$ each represents a hydrogen atom, an alkyl group, an aryl group or a heterocyclic group; Y represents an aryl group or a heterocyclic group; and Z represents a group which is released from the coupler represented by the general formula (I) when it reacts with the oxidation product of a developing agent, with the proviso that $X_a$ and $X_b$ may be connected to each other to form a nitrogen-containing heterocyclic group with the

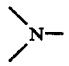

group to which they are attached.

The alkyl group represented by $X_a$ or $X_b$ is a $C_{1-30}$ saturated or unsaturated straight-chain, branched or cyclic substituted or unsubstituted alkyl group.

The aryl group represented by $X_a$ or $X_b$ is a $C_{6-30}$ substituted or unsubstituted aryl group.

The heterocyclic group represented by $X_a$ or $X_b$ is a $C_{1-20}$ 3- to 12-membered saturated or unsaturated, substituted or unsubstituted, monocyclic or condensed heterocyclic group containing as hetero atoms at least one of a nitrogen atom, an oxygen atom and a sulfur atom.

The aryl group represented by Y is a $C_{6-30}$ substituted or unsubstituted aryl group.

The heterocyclic group represented by Y is as defined with reference to $X_a$ or $X_b$.

The group represented by Z may be any of known coupling-releasable groups. These separatable groups include photographically inert groups or photographically useful groups or groups which release precursors thereof.

The N,N-substituted malondiamide type yellow couplers represented by the general formula (I) are preferably couplers represented by the following general formula (1) or (2):

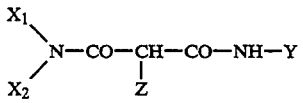

(1)

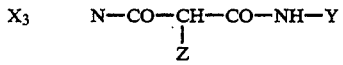

(2)

wherein $X_1$ and $X_2$ each represents an alkyl group, an aryl group or a heterocyclic group as defined with reference to $X_a$ or $X_b$ in the general formula (I); $X_3$ represents an organic residue which forms a nitrogen-containing heterocyclic group with the

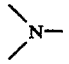

group; and Y and Z are as defined in the general formula (I).

The general formulae (1) and (2) are further described hereinafter.

The alkyl group represented by $X_1$ or $X_2$ is a $C_{1-30}$, preferably $C_{1-20}$ straight-chain, branched or cyclic saturated or unsaturated, substituted or unsubstituted alkyl group. Examples of suitable alkyl groups include methyl, ethyl, propyl, butyl, cyclopropyl, allyl, t-octyl, i-butyl, dodecyl and 2-hexyldecyl.

The heterocyclic group represented by $X_1$ or $X_2$ is a $C_{1-20}$, preferably $C_{1-10}$, 3- to 12-membered, preferably 5- or 6-membered, saturated or unsaturated, substituted or unsubstituted, monocyclic or condensed heterocyclic group containing as hetero atoms at least one of a nitrogen atom, an oxygen atom and a sulfur atom. Examples of suitable heterocyclic groups include 3-pyrrolidinyl, 1,2,4-triazole-3-yl, 2-pyridyl, 4-pyrimidinyl, 4-pyrazolyl, 2-pyrrolyl, 2,4-dioxo-1,3-imidazolidine-5-yl and pyranyl.

The aryl group represented by $X_1$ or $X_2$ is a $C_{6-20}$, preferably $C_{6-10}$, substituted or unsubstituted aryl group. Typical examples of such an aryl group include phenyl and naphthyl.

The nitrogen-containing heterocyclic group formed by $X_3$ together with the

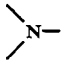

group is a $C_{1-20}$, preferably $C_{1-15}$, 3- to 12-membered, preferably 5- or 6-membered, substituted or unsubstituted, saturated or unsaturated, monocyclic or condensed heterocyclic group which may contain an oxygen atom or a sulfur atom besides annitrogen atom as hetero atoms. Examples of such a heterocyclic group include pyrrolidino, piperidino, morpholino, 1-piperadinyl, 1-indolinyl , 1,2,3,4-tetrahydroquinoline-1-yl, 1-imidazolidinyl, 1-pyrazolyl, 1-pyrrolinyl, 1-pyrazolidinyl, 2,3-dihydro-1-indazoline, 2-isoindolinyl, 1-indolyl, 1-pyrrolyl, 4-thiazine-S,S-dioxo-4-yl and benzoxazine-4-yl.

If $X_1$ and $X_2$ each represents an alkyl, aryl or heterocyclic group containing substituents and the nitrogen-containing heterocyclic group formed by $X_3$ with the

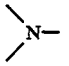

group contains substituents, examples of such substituents include a halogen atom (e.g., fluorine, chlorine), an alkoxycarbonyl group (e.g., a $C_{2-30}$, preferably $C_{2-20}$, alkoxycarbonyl group such as methoxycarbonyl and hexadecyloxycarbonyl), an acylamino group (e.g., a $C_{2-30}$, preferably $C_{2-20}$, acylamino group such as acetamide , tetradecanamide, 2- (2,4-di-t-amylphenoxy)-butanamide and benzamide), a sulfonamide group (a $C_{1-30}$, preferably $C_{1-20}$, sulfonamide group such as methanesulfonamide, hexadecyl-sulfonamide and benzensulfonamide), a carbamoyl group (a $C_{1-30}$, preferably $C_{1-20}$, carbamoyl group such as N-butylcarbamoyl and N,N-diethylcarbanmoyl) , an N-sulfonylcarbamoyl group (a $C_{1-30}$, preferably $C_{1-20}$, N-sulfonylcarbamoyl group such as N-methylcarbamoyl and N-dodecylsulfonylcarbamcyl), a sulfamoyl group (a $C_{0-30}$, preferably $C_{1-20}$, sulfamoyl group such as N-butylsulfamoyl, N-hexadecylsulfamoyl, N-3- (2,4-di-t-amylphenoxy)butylsulfamoyl and N,N-diethylsulfamoyl), an alkoxy group (a $C_{1-30}$, preferably $C_{1-20}$, alkoxy group such as methoxy, hexadecyloxy and isopropoxy), an aryloxy group (a $C_{6-20}$, preferably $C_{6-10}$, aryloxy group such as phenoxy, 4-methoxyphenoxy, 3-t-butyl-4-hydroxyphenoxy and naphthoxy), an aryloxycarbonyl group (a $C_{7-21}$, preferably $C_{7-11}$, aryloxycarbonyl group such as phenoxycarbonyl), an N-acylsulfamoyl group (a $C_{2-30}$, preferably $C_{2-20}$, N-acylsulfamoyl group such as N-propanoylsulfamoyl and N-tetradecanoylsulfamoyl), a sulfonyl group (a $C_{1-30}$, preferably $C_{1-20}$, sulfonyl group such as methanesulfonyl, 4-hydroxyphenylsulfonyl and dodecanesulfonyl), an alkoxycarbonylamino group (a $C_{2-30}$, preferably $C_{2-20}$, alkoxycarbonylamino group such as ethoxycarbonylamino), a cyano group, a nitro group, a carboxyl group, a hydroxyl group, a sulfo group, an alkylthio group (a $C_{1-30}$, preferably $C_{1-20}$, alkylthio group such as methylthio , dodecylthio and dodecylcarbamoylmethylthio), a ureide group (a $C_{1-30}$, preferably $C_{1-20}$, ureide group such as N-phenylureide and N-hexadecylureide), an aryl group (a $C_{6-20}$, preferably $C_{6-10}$, aryl group such as phenyl, naphthyl and 4-methoxyphenyl), a heterocyclic group (a $C_{1-20}$, preferably $C_{1-10}$, 3- to 12-membered, preferably 5- or 6-membered monocyclic or condensed heterocyclic group containing as hetero atoms at least one of nitrogen, oxygen and sulfur, such as 2-pyridyl, 3-pyrazolyl, 1-pyrrolyl, 2,4-dioxo-1,3-imidazolidine-1-yl, 2-benzoxazoyl, morpholino and indolyl), an alkyl group (a $C_{1-30}$, preferably $C_{1-20}$, straight-chain, branched or cyclic, saturated or unsaturated alkyl group, such as methyl, isopropyl, cyclopropyl, t-octyl, cyclopentyl, s-butyl and 2-hexyldecyl), an acyl group (a $C_{2-30}$, preferably $C_{2-20}$, acyl group such as acetyl and benzoyl), an acyloxy group (a $C_{2-30}$, preferably $C_{2-20}$, acyloxy group such as propanoyloxy and tetradecanoyloxy), an arylthio group (a $C_{6-20}$, preferably $C_{6-10}$, arylthio group such as phenylthio and naphthylthio), a sulfamoylamino group (a $C_{0-30}$, preferably $C_{0-20}$, sulfamoylamino group such as N-butylsulfamoylamino, N-dodecylsulfamoylamino and N-phenylsulfamoylamino), and an N-sulfonylsulfamoyl group (a $C_{1-30}$, preferably $C_{1-20}$, N-sulfonylsulfamoyl group such as N-methylsulfamoyl, N-ethanesulfonylsulfamoyl, N-dodecanesulfonylsulfamoyl and N-hexadecanesulfonylsulfamoyl). These substituents may further contain substituents. Examples of such substituents include those described above.

Preferred substituents are an alkoxy group, a halogen atom, an alkoxycarbonyl group, an acyloxy group, an acylamino group, a sulfonyl group, a carbamoyl group, a sulfamoyl group, a sulfonamide group, a nitro group, an alkyl group and an aryl group.

In the general formulae (1) and (2), the aryl group represented by Y is a $C_{6-20}$, preferably $C_{6-10}$, substituted or unsubstituted aryl group. Typical examples of such an aryl group include a phenyl group and a naphthyl group.

In the general formulae (1) and (2), the heterocyclic group represented by Y has the same meaning as the heterocyclic group represented by $X_1$ or $X_2$.

If Y represents a substituted aryl group or substituted heterocyclic group, examples of substituents present include those described with reference to $X_1$ which contains substituents. In a preferred embodiment of Y which contains substituents, one of these substituents is a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamide group or an alkyl group.

A particularly preferred example of Y is a phenyl group containing at least one substituent in the orthoposition.

In the general formulae (1) and (2), the group represented by Z may be any known coupling-releasable groups. Preferred examples of Z include a nitrogen-containing heterocyclic group which is to be connected to the coupling-position via a nitrogen atom, an aryloxy group, an arylthio group, a heterocyclic oxy group, a heterocyclic thio group, an acyloxy group, a carbamoyloxy group, an alkylthio group, and a halogen atom.

These releasable groups may be any of photographically inert groups or photographically useful groups or precursors thereof (e.g., a development inhibitor, a development accelerator, a desilvering acceelerator, a fogging agent, a dye, a film hardener, a coupler, a developing agent oxidant scavenger, a fluorescent dye, a developing agent, an electron transfer agent and the like).

Any known photographically useful group can be effectively used as the photographically useful group represented by Z . Examples of such a known photographically useful group include photographically useful groups or releasable groups which release these groups (e.g., a timing group) as disclosed in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, and 4,741,994, European Patent Disclosures 193389A, 348139A and 272573A.

If Z represents a nitrogen-containing heterocyclic group which is connected to the coupling-position via a nitrogen atom, the nitrogen-containing group is preferably a $C_{1-15}$, preferably $C_{1-10}$, 5- or 6-membered substituted or unsubstituted, saturated or unsaturated, monocyclic or condensed heterocyclic group. The heterocyclic group may contain as hetero atoms an oxygen atom or a sulfur atom inaddition to a nitrogen atom. Specific examples of such a heterocyclic group include 1-pyrazolyl, 1-imidazolyl, pyrrolino, 1,2,4-triazole-2-il, 1,2,3-triazole-1-yl, benzotriazolyl, benzimidazolyl, imidazolidine-2,4-dione-3-yl, oxazolidine-2,4-dione-3yl, 1,2,4-triazolidine-3,5-dione-4-yl, imidazolidine-2,4,5-trione-3-yl, 2-imidazolinone-1-yl, 3,5-dioxomorpholino, and 1-imidazoline. If these heterocyclic groups contain substituents, examples of such substituents include those described as substituents which may be present in the group represented by $X_1$. In a preferred embodiment, one of these substituents is an alkyl group, an alkoxy group, a halogen atom, an alkoxycarbonyl group, an aryloxycarbonyl group, an alkylthio group, an acylamino group, a sulfonamide group, an aryl group, a nitro group, a carbamoyl group, a cyano group or a sulfonyl group.

The aryloxy group represented by Z is preferably a $C_{6-10}$ substituted or unsubstituted aryloxy group, particularly preferably, a substituted or unsubstituted phenoxy group. If the aryloxy group contains substituents, examples of such substituents include those described as substituents which may be present in the group represented by $X_1$. In a preferred embodiment, at least one of these substituents is an electron attractive substituent such as a sulfonyl group, an alkoxycarbonyl group, a sulfamoyl group, a halogen atom, a carbamoyl group, a nitro group, a cyano group and an acyl group.

The arylthio group represented by Z is preferably a $C_{6-10}$ substituted or unsubstituted arylthio group, particularly preferably a substituted or unsubstituted phenylthio group. If the arylthio group contains substituents, examples of such substituents include those described as substituents which may be present in the group represented by $X_1$. In a preferred embodiment, at least one of these substituents is an alkyl group, an alkoxy group, a sulfonyl group, an alkoxycarbonyl group, a sulfamoyl group, a halogen atom, a carbamoyl group and a nitro group.

If Z represents a heterocyclic oxy group, the heterocyclic moiety is a $C_{1-20}$, preferably $C_{1-10}$, 3- to 12-membered, preferably 5- or 6-membered, substituted or unsubstituted, saturated or unsaturated, monocyclic or condensed heterocyclic group containing as hetero atoms at least one of a nitrogen atom, an oxygen atom and a sulfur atom. Examples of suitable heterocyclic oxy groups include a pyridyloxy group, a pyrazolyloxy group, and a furyloxy group. If the heterocyclic oxy group contains substituents, examples of suitable substituents include those described as substituents which may be present in the group represented by $X_1$. In a preferred embodiment, at least one of these substituents is an alkyl group, an aryl group, a carboxyl group, an alkoxy group, a halogen atom, an alkoxycarbonyl group, an aryloxycarbonyl group, an alkylthio group, an acylamino group, a sulfonamide group, a nitro group, a carbamoyl group, a heterocyclic group or a sulfonyl group.

If Z represents a heterocyclic thio group, the heterocyclic moiety is a $C_{1-20}$, preferably $C_{1-10}$, 3- to 12-membered, preferably 5- or 6-membered, substituted or unsubstituted, saturated or unsaturated, monocyclic or condensed heterocyclic group containing as hetero atoms at least one of a nitrogen atom, an oxygen atom and a sulfur atom. Examples of suitable heterocyclic thio groups include a tetrazolyl thio group, a 1,3,4,-thiadiazolyl thio group, a 1,3,4-oxadiazolyl thio group, a 1,3,4,-triazolthio group, a benzimidazolyl thio group, a benzothiazolyl thio group, or 2-piridylthio group. If the heterocyclic thio group contains substituents, examples of suitable substituents include those described as substituents which may be present in the group represented by $X_1$. In a preferred embodiment, at least one of these substituents is an alkyl group, an aryl group, a carboxyl group, an alkoxy group, a halogen atom, an alkoxycarbonyl group, an aryloxycarbonyl group, an alkylthio group, an acylamino group, a sulfonamide group, a nitro group, a carbamoyl group, a heterocyclic group or a sulfonyl group.

The acyloxy group represented by Z is preferably a $C_{6-10}$ monocyclic or condensed, substituted or unsubstituted aryloxy group or $C_{2-30}$, preferably $C_{2-20}$, substituted or unsubstituted alkylacyloxy group. If the acyloxy group contains substituents, examples of suitable substituents include those described as substituents which may be present in the group represented by $X_1$.

The carbamoyloxy group represented by $X_1$ is a $C_{1-30}$, preferably $C_{1-20}$, alkyl, aryl, heterocyclic, substituted or unsubstituted carbamoyloxy group. Examples of suitable a carbamoyloxy groups include N,N-diethylcarbamoyloxy, N-phenylcarbamoyloxy, 1-imidazolylcarbonyloxy, and 1-pyrrolocarbonyloxy. If the carbamoyloxy group contains substituents, examples of suitable substituents include those described as substituents which may be present in the group represented by $X_1$.

The alkylthio group represented by Z is a $C_{1-30}$, preferably $C_{1-20}$, straight-chain, branched or cyclic, saturated or unsaturated, substituted or unsubstituted alkylthio group. If the alkylthio group contains substituents, examples of suitable substituents include those described as substituents which may be present in the group represented by $X_1$.

A particularly preferred group of couplers represented by the general formulae (1) and (2) is described hereinafter.

In the general formula (1), the group represented by $X_1$ is preferably an alkyl group, particularly $C_{1-10}$ alkyl group.

In the general formulae (1) and (2), the group represented by Y is preferably an aryl group, particularly a phenyl group containing at least one substituent in the ortho-position. Examples of suitable a substituents include those described as substituents which may be present in the aryl group represented by Y. Preferred examples of suitable substituents include those described with reference to the aryl group represented by Y.

In the general formulae (1) and (2), the group represented by Z is preferably a 5- or 6-membered nitrogen-containing heterocyclic group which is connected to the coupling-position via a nitrogen atom, an aryloxy group, a 5- or 6-membered heterocyclic oxy group or a 5- or 6-membered heterocyclic thio group.

Preferred of the couplers represented by the general formulae (1) and (2) are those represented by the following general formulae (3), (4) and (5):

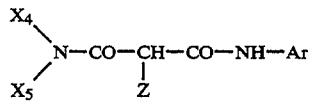
(3)

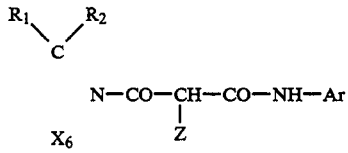
(4)

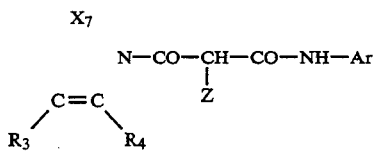
(5)

wherein Z is as defined in the general formula (1); $X_4$ represents an alkyl group; $X_5$ represents an alkyl group or an aryl group; Ar represents a phenyl group containing at least one substituent in the orthoposition; $X_6$ represents an organic residue which forms a monocyclic or condensed nitrogen-containing heterocyclic group with the $-C(R_1R_2)-N<$ group; $X_7$ represents an organic residue which forms a monocyclic or condensed nitrogen-contain-ing heterocyclic group with the $-C(R_3)=C(R_4)-N<$ group; and $R_1$, $R_2$, $R_3$ and $R_4$ each represents a hydrogen atom or a substituent.

In the general formulae (3) to (5), $X_4$ to $X_7$ and Z are as defined in the general formulae (1) and (2). If $R_1$ to $R_4$ each represents a substituent, examples of suitable substituents include those described as substituents which may be present in the group represented by $X_1$.

Particularly preferred of the couplers represented by the general formulae (3) to (5) is that represented by the general formula (4) or (5).

The couplers represented by the general formulae (1) to (5) may each form dimers or higher polymers (e.g., telomer, polymer) which are connected at the group represented by $X_1$ to $X_7$, Y, Ar, $R_1$ to $R_4$ or Z via a divalent or higher group. In this case, the dimer or higher polymer may deviate from the previously specified number of carbon atoms in the substituents.

The couplers represented by the general formulae (1) to (5) are preferably nondiffusible couplers. The term "nondiffusible coupler" as used herein means a "coupler which contains a group that makes the molecular weight of the molecule thereof large enough to immobilize the molecule in the layer in which it has been incorporated (nondiffusible group)". A $C_{8-30}$, preferably $C_{10-20}$, alkyl group or an aryl group containing substituents having 4 to 20 carbon atoms is be normally used as such a nondiffusible group. Such a nondiffusible group may be substituted at any position in the coupler molecule. A plurality of such nondiffusible groups may be present in the coupler molecule.

Specific examples of yellow couplers represented by the general formulae (1) to (5) are given below, but the present invention is not to be construed as being limited thereto.

Y-1

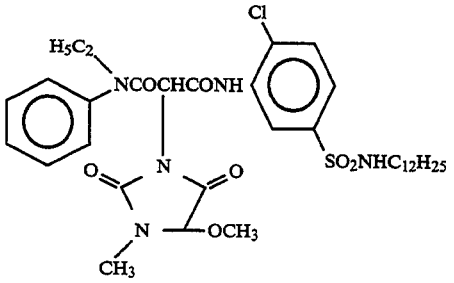

Y-2

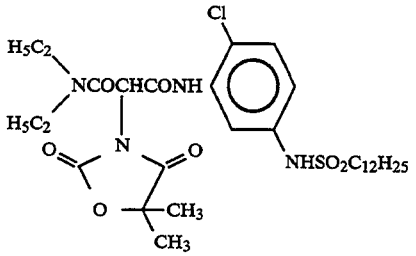

Y-3

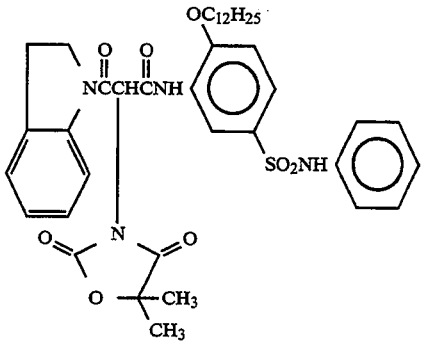

Y-4

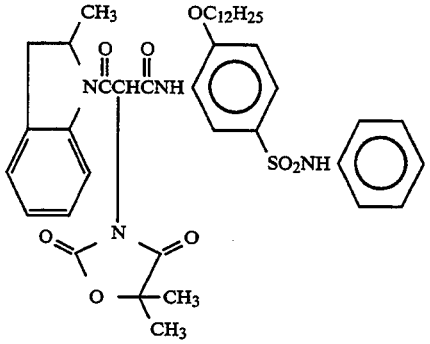

Y-5

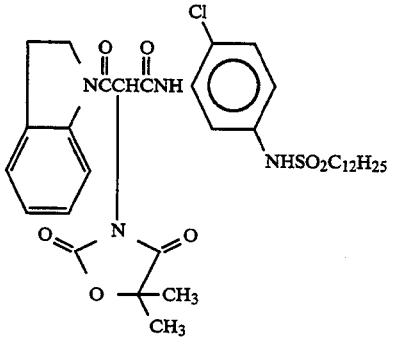

Y-6

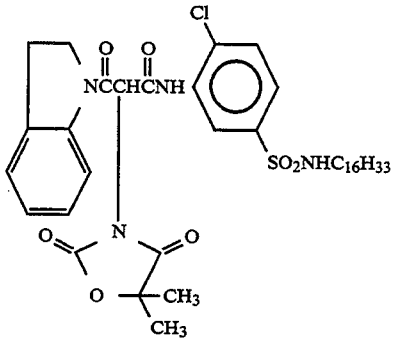

Y-7

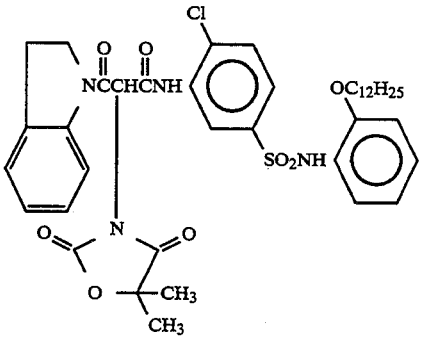

Y-8

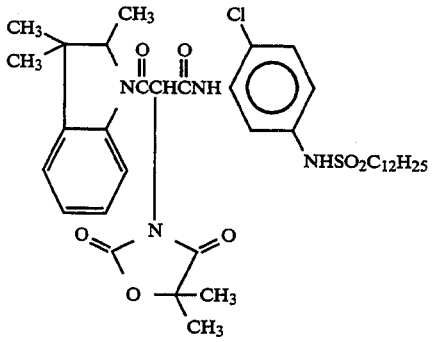

-continued
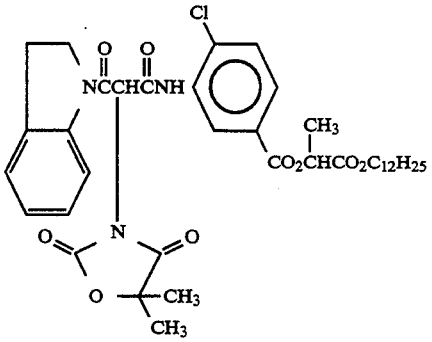
Y-9
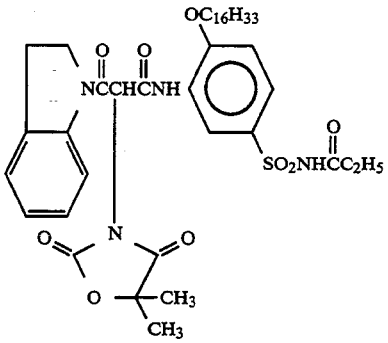
Y-10
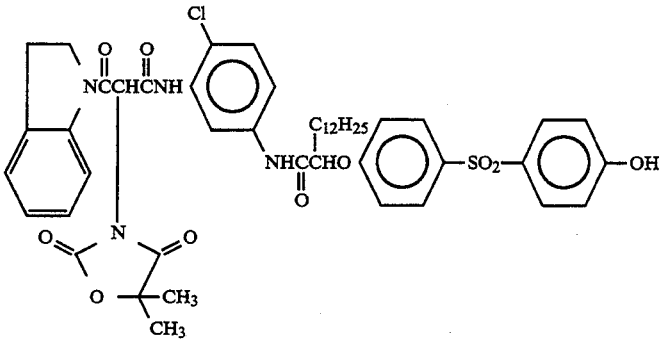
Y-11
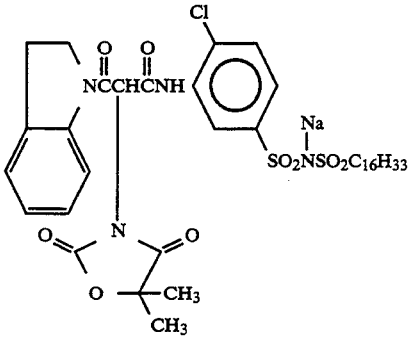
Y-12
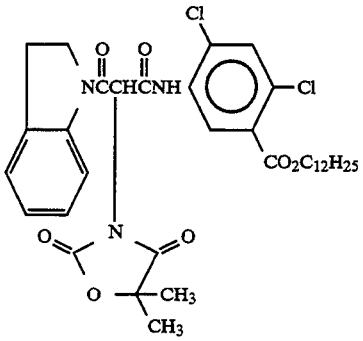
Y-13
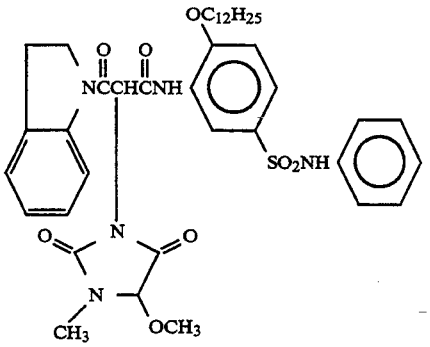
Y-14
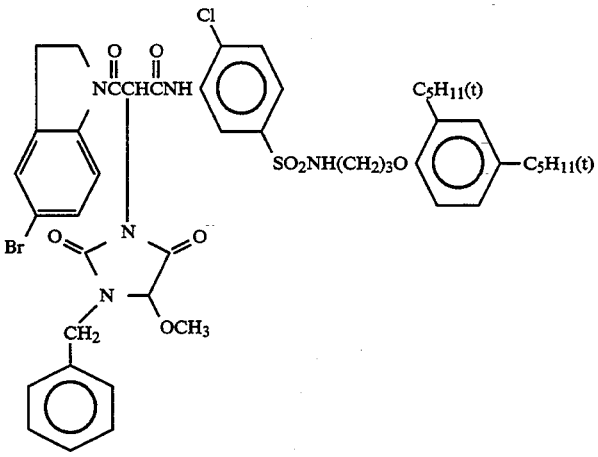
Y-15

-continued
Y-16
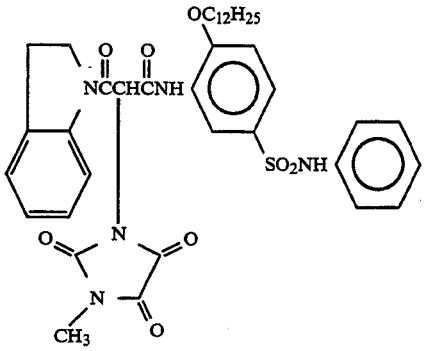
Y-17
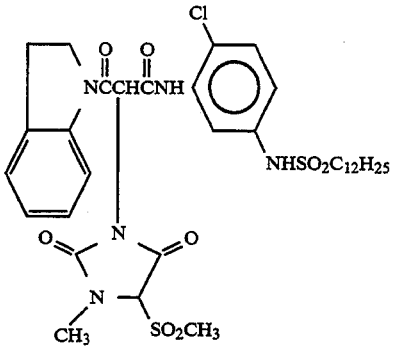
Y-18
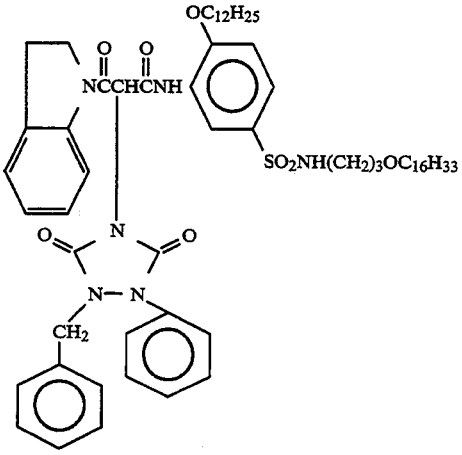
Y-19
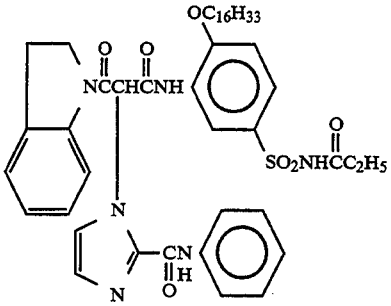
Y-20
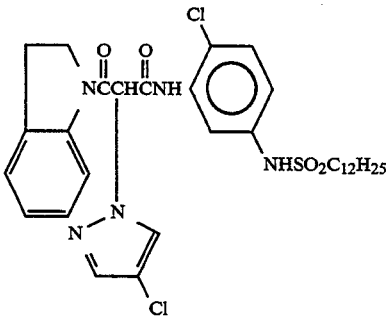
Y-21
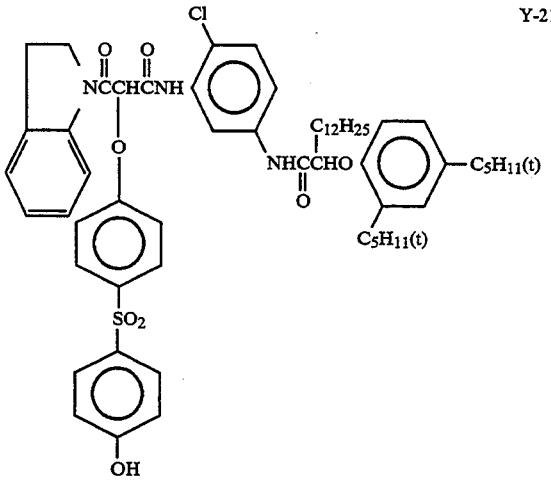
Y-22
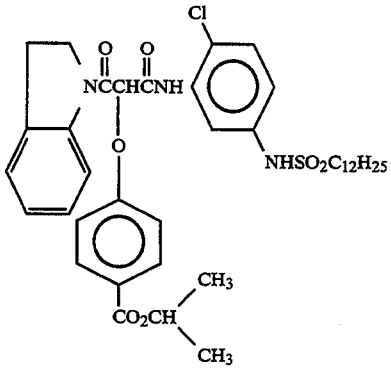
Y-23
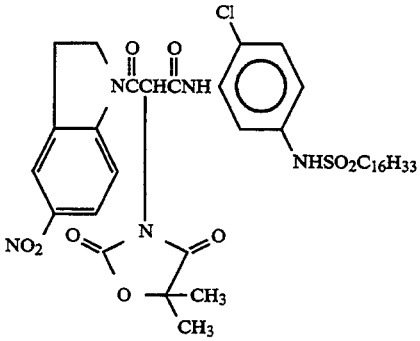

-continued
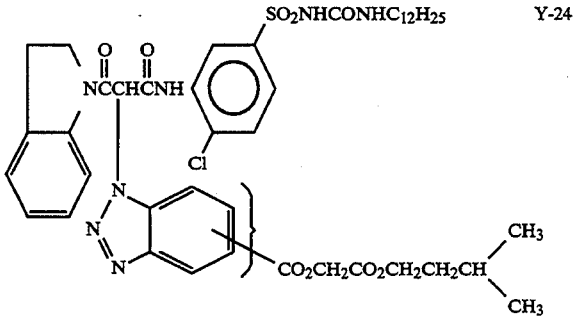
Y-24
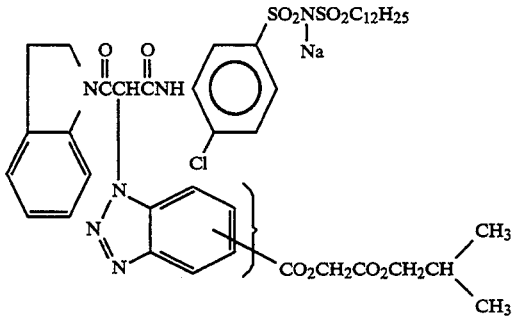
Y-25
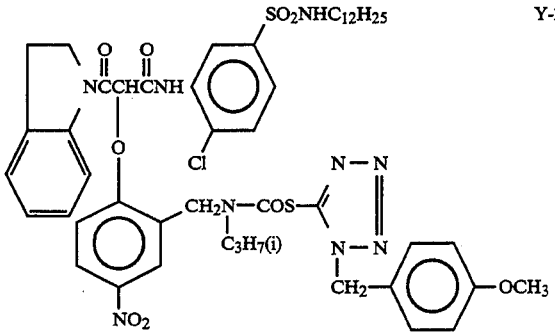
Y-26
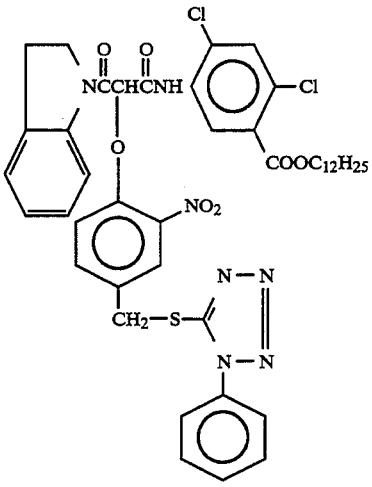
Y-27
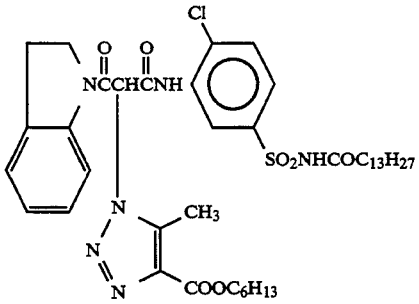
Y-28
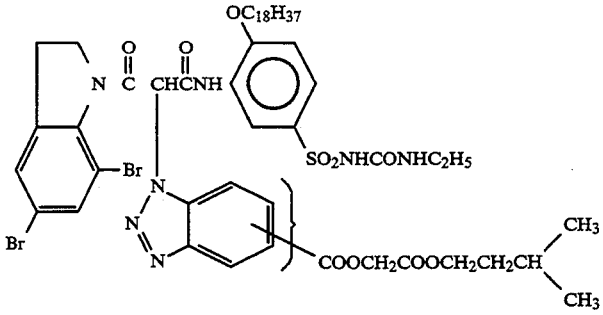
Y-29
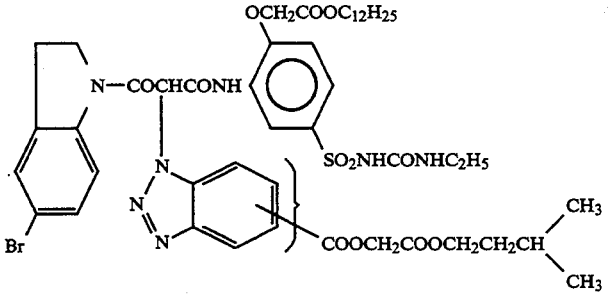
Y-30

-continued

Y-31

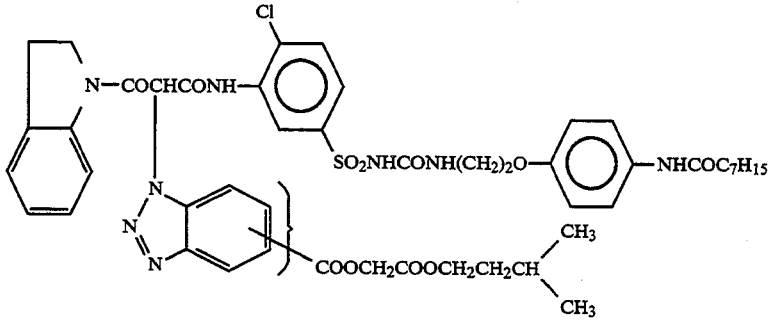

Y-32

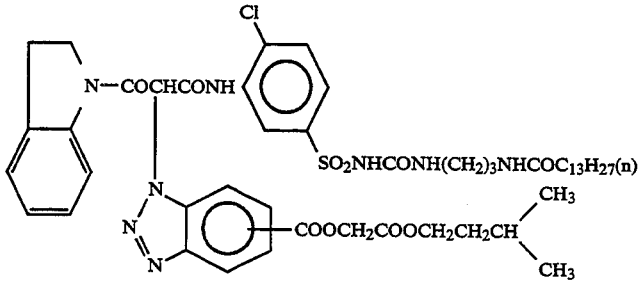

Y-33

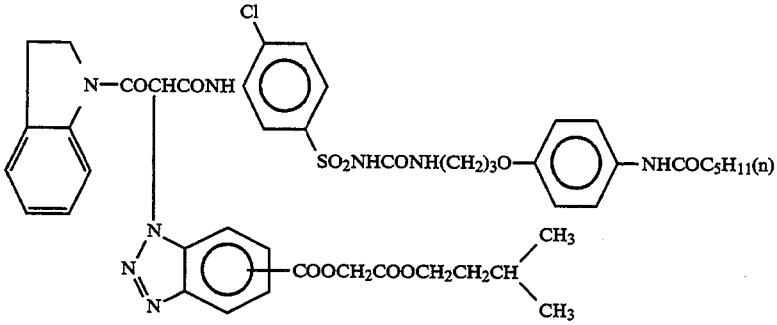

In the general formulae Y-24, Y-25, Y-29, Y-30, Y-31, Y-32, and Y-33, the parenthesis "}" indicates that the substituent is substituted in the 5- or 6-position in the benzotriazolyl group.

The yellow couplers represented by the general formulae (I), and (1) to (5) which can be used in the present invention can be synthesized in accordance with any of the methods as disclosed in French Patent 1,558,452, JP-A-52-69624, and JP-A-2-250053, European Patent Disclosure No. 447920A, and Japanese Patent Application No. 2-286341.

In the present invention, the yellow couplers represented by the general formulae (I), and (1) to (5) may each be used in an amount of $1\times10^{-3}$ to 2.0 g/m$^2$, preferably $5\times10^{-3}$ to 1.5 g/m$^2$, more preferably $1\times10^{-2}$ to 1.0 g/m$^2$ or $1\times10^{-4}$ to 2.0 mol, preferably $2\times10^{-4}$ to 1 mol, more preferably $5\times10^{-4}$ to $5\times10^{-1}$ mol per mol of silver halide.

In the present invention, the yellow couplers represented by the general formulae (I), and (1) to (5) may each be advantageously incorporated in a blue-sensitive silver halide emulsion layer or adjacent light-insensitive layers if it is used as a main coupler. If they are couplers which release a photographically useful group, they may each be incorporated in a silver halide light-sensitive layer or light-insensitive layer depending on the purpose of their use.

In the present invention, two or more of the yellow couplers represented by the general formulae (I), and (1) to (5) may be used in combination, if desired. These yellow couplers may be used in combination with other known couplers. If the yellow couplers represented by the general formulae (I), and (1) to (5), which are groups capable of releasing a photographically inert group, are used in combination with other known yellow couplers, the proportion of each of the yellow couplers represented by the general formulae (I), and (1) to (5) is preferably in the range of 50 mol % or more, particularly 70 mol % or more, based on the total amount of yellow couplers. However, this proportion is not always applicable if the yellow couplers represented by the general formulae (I), and (1) to (5) are couplers which release a photographically inert group or precursor thereof.

In the present invention, the yellow couplers represented by the general formulae (I), and (1) to (5) may be incorporated in the color light-sensitive material in accordance with various known dispersion methods.

In the oil-in-water dispersion method, which is one known dispersion method, an organic solvent having a low boiling point (e.g., ethyl acetate, butyl acetate, methyl ethyl ketone, isopropanol, etc.) can be used to coat a fine dispersion without leaving substantially any low boiling solvent in the dried film. If a high boiling organic solvent is to be used, any of the organic solvents having a boiling point of 175° C. or higher at normal pressure can be used. These high boiling organic solvents can be used alone or in admixture. The proportion of the amount of the yellow couplers represented by the general formulae (I), and (1) to (5) to the amount of these high boiling organic solvents can be varied widely and is normally in the range of 5.0 g or less, preferably 0 to 2.0 g, more preferably 0.01 to 1.0 g per g of coupler.

The latex dispersion method as described hereinafter can be used.

The yellow couplers represented by the general formulae (I), and (1) to (5) can be used in admixture or in the presence of various couplers or compounds as described hereinafter.

The light-sensitive material comprising the couplers represented by the general formulae (I), and (1) to (5) of the present invention can be processed with a color developer containing a color developing agent represented by the general formula (D) or (E) of the present invention as described hereinafter to give high color development properties and colored image fastness and an excellent image quality as well as excellent color developability.

Particularly preferred of the yellow couplers represented by the general formulae (I), and (1) to (5) are those represented by the general formulae (1) to (5). Most preferred among these couplers are those represented by the general formulae (4) and (5).

The couplers of the general formula (C) are further described hereinafter.

In the general formula (C), $R_{21}$ represents $—CONR_{24}R_{25}$, $—SO_2NR_{24}R_{25}$, $—NHCOR_{24}$, $—NHCOOR_{26}$, $—NHSO_2R_{26}$, $—NHCONR_{24}R_{25}$ or $—NHSO_2NR_{24}R_{25}$ in which $R_{24}$ and $R_{25}$, which may be the same or different, each represents a hydrogen atom, an alkyl group, an aryl group or a heterocyclic group, and $R_{26}$ represents an alkyl group, an aryl group or a heterocyclic group; $R_{22}$ represents a group which can replace a hydrogen atom in the naphthalene ring; k represents 0 or an integer of 1 to 3; $R_{23}$ represents a substituent; and $X_{21}$ represents a hydrogen atom or a group capable of being released from the molecule upon coupling with the oxidation product of an aromatic primary amine developing agent, with the proviso that if k is plural, the plurality of $(R_{22})$'s may be the same or different or they may combine with each other to form a ring and that $R_{22}$ and $R_{23}$ or $R_{23}$ and $X_{21}$ may combine with each other to form a ring.

The coupler represented by the general formula (C) may form dimers or higher polymers (including polymers comprising a coupler connected to a high molecular weight main chain) which are connected to each other at $R_{21}$, $R_{22}$, $R_{23}$ or $X_{21}$ via a divalent or higher group.

In the present invention, the alkyl group may be a straight-chain, branched or cyclic alkyl group which may further contain unsaturated bonds or substituents (e.g., a halogen atom, an aryl group, a heterocyclic group, an alkoxy group, an aryloxy group, an alkylsulfonyl group, an arylsulfonyl group, an alkoxycarbonyl group, an acyloxy group, or an acyl group).

The aryl group may be a condensed ring (e.g., a naphthyl group) or may contain substituents (e.g., those described with reference to the above described alkyl group, e.g., an alkyl group, a cyano group, a carbonamide group, a sulfonamide group, a carbamoyl group, a sulfamoyl group, an ureide group, or an alkoxycarbonylamino group).

The heterocyclic group is a 3- to 8-membered monocyclic or condensed heterocyclic group containing at least one hetero atom selected from the group consisting of O, N, S, P, Se and Te in the ring which may contain substituents (e.g., those described with reference to the foregoing aryl group, and a hydroxyl group, a carboxyl group, a nitro group, an amino group, an aryloxycarbonyl group).

$R_{21}$ is preferably a $C_{1-30}$ carbamoyl group (e.g., N-n-butylcarbamoyl, N-n-hexadecylcarbamoyl, N-[3-(2,4-di-t-pentylphenoxy)propyl]carbamoyl, N-(3-n-dodecyloxypropyl)carbamoyl), N-(3-n-dodecyloxy-2-methylpropyl)carbamoyl, N-[3-(4-t-octylphenoxy)-propyl]carbamoyl) or a $C_{0-30}$ sulfamoyl group (e.g., N-(3-n-dodecyloxypropyl)sulfamoyl, N-[4-(2,4-di-t-oentylphenoxy)butyl]sulfamoyl), particularly a carbamoyl group.

The suffix k is preferably 0 or an integer 1, particularly 0. $R_{22}$ is preferably a halogen atom (e.g., F, Cl, Br, I, hereinafter the same) , a cyano group, a $C_{1-12}$ alkyl group, an alkoxy group, a carbonamide group or a sulfonamide group.

$R_{23}$ is preferably $—COR_{27}$, $—SO_2R_{28}$, $—CO2R_{28}$, $—PO(OR_{28})_2$ or $—PO(R_{28})_2$ in which $R_{27}$ has the same meaning as $R_{24}$ and $R_{28}$ has the same meaning as $R_{26}$. $R_{23}$ is particularly preferably a $C_{1-30}$ $—COR_{27}$ group (e.g., acetyl, trifluoroacetyl, pivaloyl, benzoyl), a $C_{1-30}$ $—SO_2R_{28}$ group (e.g., methylsulfonyl, n-butylsulfonyl, p-tolylsulfonyl) or $C_{2-30}$ $—CO_2R_{28}$ group (e.g., methoxycarbonyl, isobutoxycarbonyl, 2-ethylhexyloxycarbonyl), further preferably $—CO_2R_{28}$.

$X_{21}$ is preferably a hydrogen atom, a halogen atom, a $C_{1-30}$ alkoxy group (e.g., 2-hydroxyethoxy, 2-(carboxymethylthio)ethoxy, 3-carboxyethoxy, 2-methoxyethoxy), $C_{6-30}$ aryloxy group (e.g., 4-methoxyphenoxy, 4-(3-carboxypropanamide)phenoxy), a $C_{2-30}$ alkylthio group (e.g., carboxymethylthio, 2-carboxyethylthio, 2-hydroxyethylthio, 2,3-dihydroxypropylthio) or a $C_{6-30}$ arylthio group (e.g., 4-t-butylphenylthio, 4-(3-carboxypropanamide)phenylthio), particularly a hydrogen atom, a chlorine atom, an alkoxy group or an alkylthio group.

Specific non-limiting examples of cyan coupler represented by the general formula (C) are given below.

(C-1)

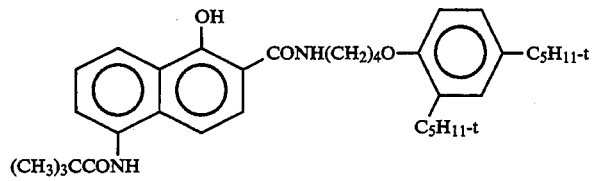

-continued
(C-2)
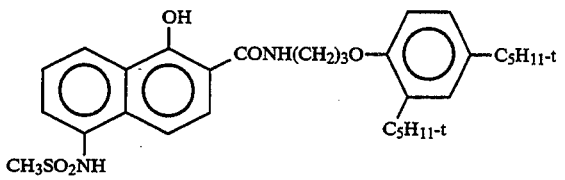
(C-3)
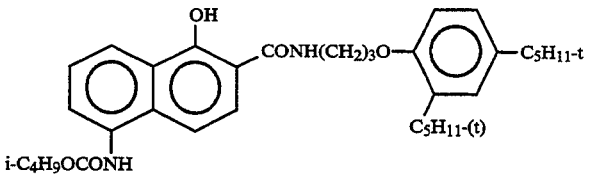
(C-4)
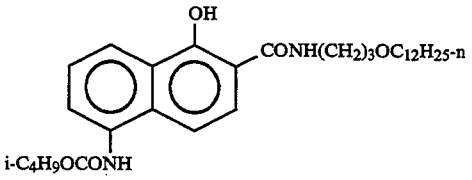
(C-5)
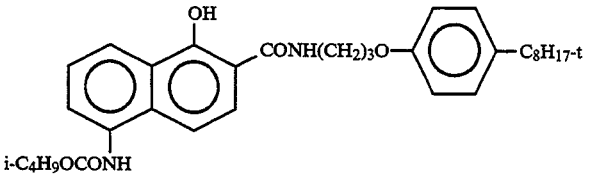
(C-6)
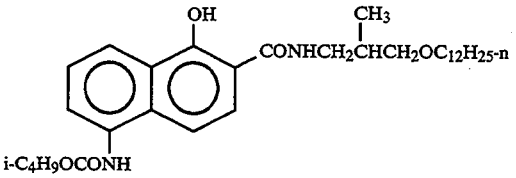
(C-7)
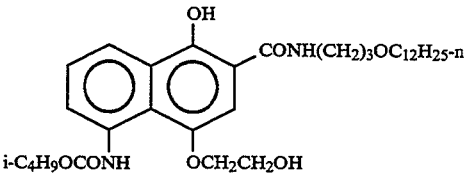
(C-8)
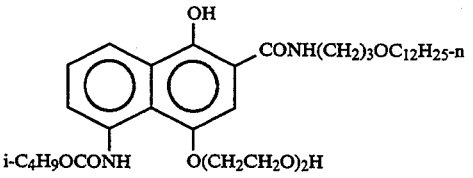
(C-9)
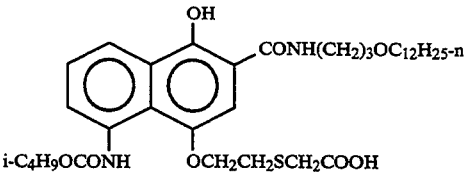
(C-10)
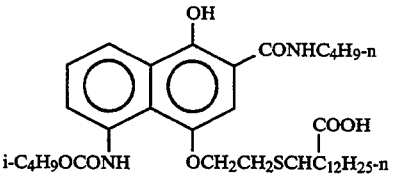

-continued (C-11)

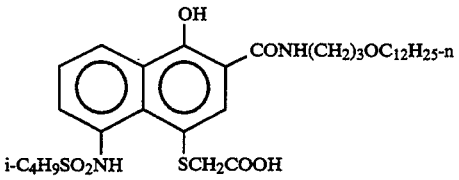

(C-12)

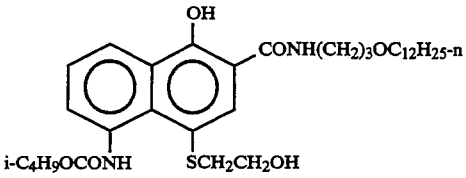

(C-13)

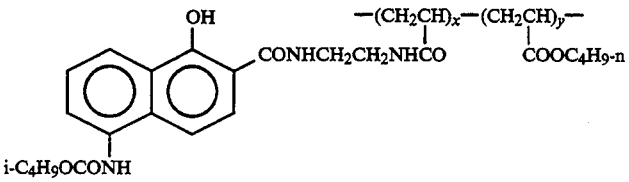

x:y = 50:50 (weight ratio)
Number-average molecular weight: 60,000

(C-14)

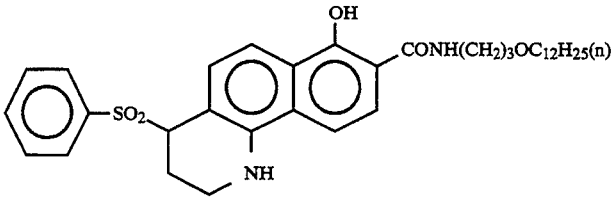

(C-15)

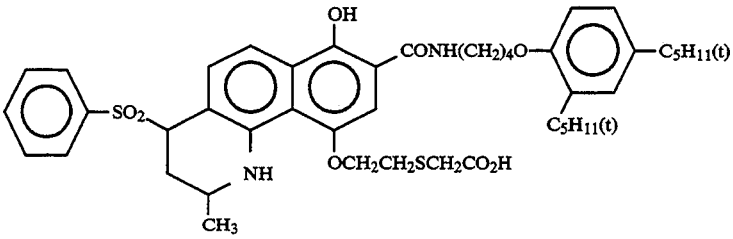

(C-16)

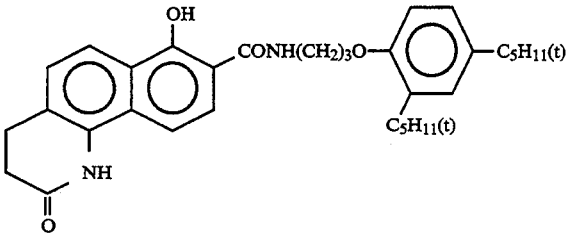

Other specific examples of cyan couplers represented by the general formula (C) and/or methods for the synthesis of these compounds are disclosed in U.S. Pat. No. 4,690,889, JP-A-60-237448, JP-A-61-153640, JP-A-61-145557, and JP-A-63-208042, and West German Patent 3,823,049A.

The total amount of cyan couplers represented by the general formula (C) employed is in the range of 30 mol % or more, preferably 50 mol % or more, more preferably 70 mol % or more, particularly 90 mol % or more based on the total weight of cyan couplers present.

Preferably, two or more cyan couplers represented by the general formula (C) are used in combination. If one color-sensitive layer comprises two or more layers having different sensitivities, it is preferable that the highest sensitivity layer comprises a two-equivalent cyan coupler while the lowest sensitivity layer comprises a four-equivalent cyan coupler. The other layers preferably comprises either or both of a two-equivalent cyan coupler and a four-equivalent cyan coupler.

As described in JP-A-62-269958, it is further advantageous for the cyan coupler represented by the general formula (C) to be used in the presence of a small amount of a high boiling organic solvent for dispersion to improve sharpness and image preservability after processing.

The color light-sensitive material comprising a cyan coupler represented by the general formula (C) of the present invention can be processed with a color developer containing a color developing agent represented by the general formula (D) or (E) of the present invention as described hereinafter to exhibit a high color developability and excellent colored image fastness and image quality.

If a light-sensitive material comprising yellow couplers represented by the general formulae (I), and (1) to (5), particularly (4) and (5), further comprises a cyan coupler represented by the general formula (C), higher colored image fastness and image quality are admired.

The aromatic primary amine color developing agent represented by the general formula (D) or (E) are further described hereinafter in detail.

Firstly, the general formula (D) will be further described hereinafter. In the general formula (D), $R_1$ represents a $C_{1-6}$ straight-chain or branched alkyl group or a $C_{3-6}$ straight-chain or branched hydroxylalkyl group. Specific examples of suitable alkyl groups or hydroxylalkyl groups include a methyl group, an ethyl group, an n-propyl group, an isopropyl group, an n-butyl group, a sec-butyl group, an n-hexyl group, a neopentyl group, a 3-hydroxypropyl group, a 4-hydroxybutyl group, a 5-hydroxypentyl group, a 6-hydroxyhexyl group, a 4-hydroxypentyl group, a 3-hydroxybutyl group, a 4-hydroxy-4-methylpentyl group, and a 5,6-dihydroxyhexyl group.

$R_2$ represents a $C_{3-6}$ straight-chain or branched alkylene group or a $C_{3-6}$ straight-chain or branched hydroxyalkylene group. Specific examples of suitable alkylene groups or hydroxyalkylene groups include a trimethylene group, a tetramethylene group, a pentamethylene group, a hexamethylene group, a 1-methylethylene group, a 2-methylethylene group, a 1-methyltrimethylene group, a 2-methyltrimethylene group, a 3-methyltrimethylene group, a 3-methylpentamethylene group, a 2-methylpentamethylene group, a 2-ethyltrimethylene group, and a 3-hydroxypentamethylene group.

In the general formula (D), if $R_1$ is a straight-chain or branched alkyl group, it preferably contains 1 to 4 carbon atoms. Particularly preferred of these alkyl groups are a methyl group, an ethyl group, and an n-propyl group. Most preferred of these alkyl groups is an ethyl group. If $R_1$ is a $C_{1-4}$ straight-chain or branched alkyl group, $R_2$ is preferably a $C_{3-4}$ straight-chain or branched alkylene group. Particularly preferred of these alkylene groups are a trimethylene group, and a tetra-methylene group. Most preferred of these alkylene groups is a tetramethylene group. On the other hand, in the general formula (D), if $R_1$ is a $C_{3-6}$ straight-chain or branched hydroxyalkyl group, the number of carbon atoms present in $R_2$ is preferably in the range of 4 to 6, more preferably 5 or 6.

In the general formula (D), $R_1$ is preferably a $C_{1-4}$ straight-chain or branched alkyl group.

$R_3$ represents a hydrogen atom, a $C_{1-4}$ straight-chain or branched alkyl group or a $C_{1-4}$ straight-chain or branched alkoxy group. Specific examples of $R_3$ include a hydrogen atom, a methyl group, an ethyl group, an n-propyl group, an isopropyl group, a sec-butyl group, a methoxy group, an ethoxy group, and an isopropoxy group. $R_3$ is preferably an alkyl group, particularly a methyl group or an ethyl group, most preferably a methyl group.

Specific examples of typical developing agent represented by the general formula (D) of the present invention are given below, but the present invention is not to be construed as being limited thereto.

(D)

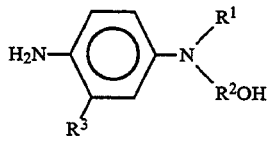

| Compound No. | $R^1$ | $R^2$ | $R^3$ |
|---|---|---|---|
| D-1 | $-CH_3$ | $-(CH_2)_3-$ | $-CH_3$ |
| D-2 | $-C_2H_5$ | $-(CH_2)_3-$ | $-CH_3$ |
| D-3 | $-C_2H_5$ | $-CH_2CH(CH_3)-$ | $-CH_3$ |
| D-4 | $-C_2H_5$ | $-CH(CH_3)-CH_2-$ | $-CH_3$ |
| D-5 | $-CH_3$ | $-(CH_2)_3-$ | $-C_2H_5$ |
| D-6 | $-C_2H_5$ | $-(CH_2)_3-$ | $-C_2H_5$ |
| D-7 | $-C_3H_7(n)$ | $-(CH_2)_3-$ | $-CH_3$ |
| D-8 | $-CH_3$ | $-(CH_2)_3-$ | $-C_3H_7(n)$ |
| D-9 | $-CH_3$ | $-(CH_2)_3-$ | $-C_4H_9(n)$ |
| D-10 | $-C_4H_9(n)$ | $-(CH_2)_3-$ | $-CH_3$ |
| D-11 | $-C_3H_7(n)$ | $-(CH_2)_4-$ | $-CH_3$ |
| D-12 | $-C_2H_5$ | $-(CH_2)_4-$ | $-CH_3$ |
| D-13 | $-CH_3$ | $-CH_2CH(CH_3)CH_2-$ | $-C_2H_5$ |
| D-14 | $-C_2H_5$ | $-CH_2CH_2CH(CH_3)-$ | $-C_2H_5$ |

-continued

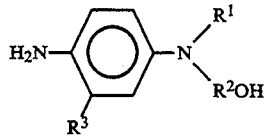

(D)

| Compound No. | $R^1$ | $R^2$ | $R^3$ |
|---|---|---|---|
| D-15 | $-C_2H_5$ | $-CH_2CH(CH_3)CH_2-$ | $-CH_3$ |
| D-16 | $-C_{25}$ | $-CH_2CH_2CH(CH_3)-$ | $-CH_3$ |
| D-17 | $-C_2H_5$ | $-(CH_2)_5-$ | $-CH_3$ |
| D-18 | $-C_2H_5$ | $-(CH_2)_6-$ | $-CH_3$ |
| D-19 | $-(CH_2)_3OH$ | $-(CH_2)_3-$ | $-C_2H_5$ |
| D-20 | $-(CH_2)_5OH$ | $-(CH_2)_5-$ | $-CH_3$ |
| D-21 | $-(CH_2)_5OH$ | $-(CH_2)_6-$ | $-CH_3$ |
| D-22 | $-(CH_2)_5OH$ | $-(CH_2)_5-$ | $-C_2H_5$ |
| D-23 | $-(CH_2)_4OH$ | $-(CH_2)_5-$ | $-C_3H_7(i)$ |
| D-24 | $-(CH_2)_5OH$ | $-(CH_2)_3-CH(CH_3)-$ | $-CH_3$ |
| D-25 | $-C_3H_7(n)$ | $-(CH_2)_3-CH(CH_3)CH_2-$ | $-C_2H_5$ |
| D-26 | $-CH_2CH_2CH(OH)CH_2CH_3$ | $-(CH_2)_5-$ | $-CH_3$ |
| D-27 | $-CH_2CH(OH)C_2H_5$ | $-(CH_2)_4-$ | $-C_2H_5$ |
| D-28 | $-(CH_2)_4OH$ | $-(CH_2)_4-$ | $-C_4H_9(t)$ |
| D-29 | $-C_2H_5$ | $-(CH_2)_3-$ | H |
| D-30 | $-C_2H_5$ | $-(CH_2)_4-$ | $-OCH_3$ |
| D-31 | $-(CH_2)_5OH$ | $-(CH_2)_5-$ | $-OC_2H_5$ |
| D-32 | $-CH_2CH_2CH(OH)C_2H_5$ | $-(CH_2)_5-$ | H |
| D-33 | $-C_3H_7(n)$ | $-(CH_2)_4-$ | H |
| D-34 | $-(CH_2)_4OH$ | $-(CH_2)_4-$ | $-OC_3H_7(i)$ |
| D-35 | $-(CH_2)_5OH$ | $-(CH_2)_6-$ | H |
| D-36 | $-CH_3$ | $-(CH_2)_3-$ | $-OC_4H_9(t)$ |

Preferred of the compounds represented by the general formula (D) are Compounds D-2, D-12 and D-20. Most preferred among these compounds is compound D-12.

$R_{11}$, n, $R_{12}$ and m in the compound represented by the general formula (E) are further described hereinafter.

$R_{11}$ is a substituent. More particularly, $R_{11}$ represents a halogen atom, an alkyl group, an aryl group, a heterocyclic group, a cyano group, a nitro group, a hydroxyl group, a carboxyl group, an alkoxy group, an aryloxy group, an acylamino group, an alkylamino group, an anilino group, a ureide group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imide group, a heterocyclic thio group, a sulfinyl group, a phosphonyl group, an aryloxycarbonyl group or an acyl group.

Examples of substituents represented by $R_{11}$ are further described hereinafter. Examples of a halogen atom represented by $R_{11}$ include a fluorine atom, and a chlorine atom. Examples of alkyl groups represented by $R_{11}$ include a $C_{1-16}$, preferably $C_{1-6}$ straight-chain, branched or cyclic alkyl groups which may be substituted by an alkenyl group, an alkinyl group, an aryl group, a hydroxyl group, a nitro group, a cyano group, a halogen atom or other substituents formed by oxygen atoms, nitrogen atoms, sulfur atoms or carbon atoms. Examples of such an alkyl group include methyl, ethyl, propyl, isopropyl, t-butyl, 2-hydroxyethyl, 3-hydroxypropyl, benzyl , 2-methanesulfonamidoethyl , 3-methanesulfonamidopropyl, 2-methanesulfonylethyl, 2-methoxyethyl, cyclopentyl, 2-acetamidoethyl, 2-carboxylethyl, 2-carbamoylethyl, 3-carbamoylpropyl, n-hexyl, 2-hydroxypropyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl, and 4-nitrobutyl.

The aryl group represented by $R_{11}$ is a $C_{6-24}$ aryl group which may be substituted by an alkyl group, an alkenyl group, an alkinyl group, an aryl group, a hydroxyl group, a nitro group, a cyano group, a halogen atom or other substituents formed by oxygen atoms, nitrogen atoms, sulfur atoms or carbon atoms. Examples of suitable aryl groups include phenyl, naphthyl, and p-methoxyphenyl. The heterocyclic group represented by $R_{11}$ is a $C_{1-5}$ 5- or 6-membered aromatic or aliphatic heterocyclic group containing one or more oxygen atoms, nitrogen atoms or sulfur atoms. The number of hetero atoms in the ring and the number of elements in the ring may be single or plural. These heterocyclic groups may be further substituted by a $C_{1-16}$ alkyl group, an alkenyl group, an alkinyl group, an aryl group, a hydroxyl group, a nitro group, a cyano group, a halogen atom or other substituents formed by oxygen atoms, nitrogen atoms, sulfur atoms or carbon atoms. Examples of suitable heterocyclic groups include 2-furyl, 2-thienyl, 2-pyrimidinyl, 2-benzotriazolyl, imidazolyl, and pyrazolyl.

The alkoxy group represented by $R_{11}$ is a $C_{1-16}$, preferably $C_{1-6}$, alkoxy group which may be substituted by an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable alkoxy groups include methoxy, ethoxy, 2-methoxyethoxy, and 2-methanesulfonylethoxy. The aryloxy group represented by $R_{11}$ is a $C_{6-24}$ aryloxy group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable aryloxy groups include phenoxy. The acylamino group represented by $R_{11}$ is a $C_{1-16}$, preferably $C_{1-6}$, acylamino group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable acylamino groups include acetamide, and 2-methoxypropionamide.

The alkylamino group represented by $R_{11}$ is a $C_{1-16}$, preferably $C_{1-6}$, alkylamino group which may be substituted by an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable alkylamino groups include dimethylamino, and diethylamino. The anilino group represented by $R_{11}$ is a $C_{6-24}$ anilino group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable anilino groups include anilino, and m-nitroanilino. The ureide group represented by $R_{11}$ is a $C_{1-16}$, preferably $C_{1-6}$, ureide group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable ureide groups include methylureide, and N,N-diethylureide.

The sulfamoylamino group represented by $R_{11}$ is a $C_{0-16}$, preferably $C_{0-6}$, sulfamoylamino group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable sulfamoylamino groups include dimethylsulfamoylamino. The alkylthio group represented by $R_{11}$ is a $C_{1-16}$, preferably $C_{1-6}$, alkylthio group which may be substituted by an alkenyl group, an alkynyl group, an aryl group, a hydroxyl group, a nitro group, a cyano group, a halogen atom or other substituents formed by an oxygen atom, a nitrogen atom, a sulfur atom or a carbon atom. Examples of suitable alkylthio groups include methylthio, and ethylthio. The arylthio group represented by $R_{11}$ is a $C_{6-24}$ arylthio group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. A example of suitable arylthio group is phenylthio. The alkoxycarbonamino group represented by $R_{11}$ is a $C_{2-16}$, preferably $C_{2-6}$, alkoxycarbonylamino group which may be substituted by an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable alkoxycarbonylamino groups include methoxycarbonylamino and ethoxycarbonylamino.

The sulfonamide group represented by $R_{11}$ is a $C_{1-16}$, preferably $C_{1-6}$, sulfonamide group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. A example of suitable sulfonamide group is methanesulfonamide. The carbamoyl group represented by $R_{11}$ is a $C_{1-16}$, preferably $C_{1-6}$, carbamoyl group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of such a carbamoyl group include N,N-dimethylcarbamoyl and N-ethylcarbamoyl. The sulfamoyl group represented by $R_{11}$ is a $C_{0-16}$, preferably $C_{0-6}$, sulfamoyl group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. A example of suitable sulfamoyl group is dimethylsulfamoyl.

The sulfonyl group represented by $R_{11}$ is a $C_{1-16}$, preferably $C_{1-6}$, aliphatic or aromatic sulfonyl group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable sulfonyl groups include methanesulfonyl and ethanesulfonyl. The alkoxycarbonyl group represented by $R_{11}$ is a $C_{1-16}$, preferably $C_{1-6}$, alkoxycarbonyl group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable alkoxycarbonyl groups include methoxycarbonyl and ethoxycarbonyl. The heterocyclic oxy group represented by $R_{11}$ is a $C_{1-5}$ 5- or 6-membered aromatic or aliphatic heterocyclic oxy group containing one or more oxygen atoms, nitrogen atoms or sulfur atoms. The number of hetero atoms of the ring and the number of elements of the ring may be single or plural. These heterocyclic groups may be further substituted by a $C_{1-16}$ alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable heterocyclic oxy groups include 1-phenyltetazolyl-5-oxy and 2-tetrahydropyranyloxy.

The azo group represented by $R_{11}$ is a $C_{1-16}$, preferably $C_{1-6}$, azo group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable azo groups include phenylazo and 2-hydroxy-4-propanoylphenylazo. The acyloxy group represented by $R_{11}$ is a $C_{1-16}$, preferably $C_{1-6}$, acyloxy group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. An example of suitable acyloxy group is acetoxy. The carbamoyloxy group represented by $R_{11}$ is a $C_{1-16}$, preferably $C_{1-6}$, carbamoyloxy group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. A example of suitable carbamoyloxy group is N,N-dimethylcarbamoyloxy.

The silyl group represented by $R_{11}$ is a $C_{3-16}$, preferably $C_{3-6}$, silyl group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. An example of suitable silyl group is trimethylsilyl. The silyloxy group represented by $R_{11}$ is a $C_{3-16}$, preferably $C_{3-6}$, silyloxy group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. An example of suitable silyloxy group is trimethylsilyloxy. The aryloxycarbonylamino group represented by $R_{11}$ is a $C_{7-24}$ aryloxycarbonylamino group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. An example of suitable aryloxycarbonylamino group is phenoxycarbonylamino.

The imide group represented by $R_{11}$ is a $C_{4-16}$ imide group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. An example of suitable imide group is N-succinimide. The heterocyclic thio group represented by $R_{11}$ is a $C_{1-5}$ 5- or 6-membered aromatic or aliphatic heterocyclic thio group containing one or more oxygen atoms, nitrogen atoms or sulfur atoms. The number of hetero atoms of the ring and the number of elements of the ring may be single or plural. These heterocyclic thio groups may be further substituted by a $C_{1-16}$ alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable heterocyclic thio groups include 2-benzothiazolylthio and 2-pyridylthio.

The sulfinyl group represented by $R_{11}$ is a $C_{1-16}$, preferably $C_{1-6}$, sulfinyl group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. An example of suitable sulfinyl group is ethanesulfinyl. The phosphonyl group represented by $R_{11}$ is a $C_{2-16}$, preferably $C_{2-6}$, phosphonyl group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. An example of suitable phosphonyl group is methoxyphosphonyl. The aryloxycarbonyl group represented by $R_{11}$ is a $C_{7-24}$ acylamino group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. An example of suitable aryloxycarbonyl group is phenoxycarbonyl. The acyl group represented by $R_{11}$ is a $C_{1-16}$, preferably $C_{1-6}$, acyl group which may be substituted by an alkyl group, an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable acyl groups include acetyl and benzoyl.

Preferred of these substituents represented by $R_{11}$ are an alkyl group, a cyano group, a hydroxyl group, a carboxyl group, an alkoxy group, an acylamino group, an alkylamino group, a ureide group, a sulfamoylamino group, an alkylthio group, an alkoxycarbonylamino group, a sulfonamide group, a carbamoyl group, a sulfamoyl group, a sulfonyl group, and a carbamoyloxy group. More preferred of these substituents are an alkyl group, a hydroxyl group, an alkoxy group, a ureide group, a sulfamoylamino group, an alkoxycarbonylamino group, a sulfonamide group, and a sulfamoyl group. Most preferred of these substituents are an alkyl group, a hydroxyl group, an alkoxy group, a sulfamoylamino group, a sulfonamide group, and a sulfamoyl group. Preferred examples of suitable alkyl groups include methyl, ethyl, hydroxymethyl, 2-hydroxyethyl, 3-hydroxypropyl, methanesulfonamidemethyl, 2-methanesulfonamideethyl, and 3-hydroxypropyl.

The subscript n represents 0 or an integer of 1 to 8. When n is 2 or more, the plurality of $R_1$'s may be the same or different. The subscript n is preferably an integer of 1 to 6, more preferably 1 to 4.

$R_{12}$ represents a substituent. $R_{12}$ is as defined with reference to $R_{11}$.

Preferred examples of substituent represented by $R_{12}$ include an alkyl group, an alkoxy group, an alkoxycarbonylamino group, and a ureide group. Further preferred of these substituents are an alkyl group, and an alkoxy group. Particularly preferred of these substituents is an alkyl group. Preferred examples of suitable alkyl groups include methyl, ethyl, propyl, isopropyl, t-butyl, 2-hydroxyethyl, 3-hydroxypropyl, 2-methanesulfonamideethyl, 3-methanesulfonamidepropyl, 2-methanesulfonylethyl, 2-methoxyethyl, 2-carbamoylethyl, 3-carbamoylpropyl, 2-hydroxypropyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl, and 4-nitrobutyl. Particularly preferred of these alkyl groups are methyl and ethyl.

The subscript m represents 0 or an integer of 1 to 4. When m is 2 or more, the plurality of $R_{12}$'s may be the same or different or may form a ring. If the $R_{12}$'s form a ring, the number of members of the ring is not specifically limited but is preferably 5, 6 or 7.

The subscript m is preferably 0 or 1. In a preferred embodiment, m is 0 or $R_{12}$ is connected to the ortho-position in the primary amino group and m is 1. In the most preferred embodiment, $R_{12}$ is connected to the ortho- position in the primary amino group and m is 1.

Preferred compounds of the general formula (E) are those represented by the following general formula (F):

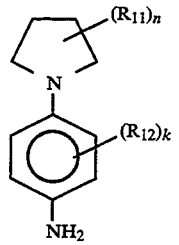

(F)

wherein $R_{11}$, n and $R_{12}$ are as defined above; and k represents 0 or an integer of 1.

Also preferred of the compounds represented by the general formula (E) are those represented by the following general formula (G):

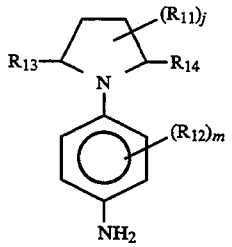

(G)

wherein $R_{11}$, $R_{12}$ and m are as defined in the general formula (E); j represents 0 or an integer of 1 to 6; and $R_{13}$ and $R_{14}$ each represents an alkyl group which may be substituted, and $R_{13}$ and $R_{14}$ may be the same or different.

Compounds represented by the general formula (G) include compounds in stereoisomeric form and the specific stereoisomers thereof.

Compounds represented by the general formula (G) are preferred to those represented by the general formula (F).

The subscript j, $R_{13}$ and $R_{14}$ in the general formula (G) are further described hereinafter.

The suffix j represents 0 or an integer of 1 to 6. When j is 2 or more, the plurality of $R_{11}$'s may be the same or different. The subscript j is preferably 0 or an integer of 1 to 4, more preferably 0 to 2, most preferably 0 or 1.

$R_{13}$ and $R_{14}$ each represents an alkyl group which may be substituted. $R_{13}$ and $R_{14}$ may be the same or different. The alkyl group which may be substituted is a $C_{1-16}$, preferably $C_{1-6}$ straight-chain, branched or cyclic alkyl group which may be substituted by an alkenyl group, an alkynyl group, an aryl group, a hydroxyl group, a nitro group, a cyano group, a halogen atom or other substituents formed by oxygen atoms, nitrogen atoms, sulfur atoms or carbon atoms. Examples of suitable alkyl groups include methyl, ethyl, propyl, isopropyl, t-butyl, hydroxymethyl, methanesulfonamidemethyl, methoxymethyl, 2-hydroxyethyl, 3-hydroxypropyl, benzyl, 2-methanesulfonamideethyl, 2,3-dihydroxypropyl, 3-methanesulfonamidepropyl, 2-methanesulfonylethyl, 2-methoxyethyl, cyclopentyl, sulfamoylmethyl, 2-acetamideethyl, 2-carboxyethyl, 2-carbamoylethyl, 3-carbamoylpropyl, n-hexyl, 2-hydroxypropyl, methylaminosulfamoylaminomethyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl and 4-nitrobutyl.

Preferred of the alkyl groups represented by $R_{13}$ and $R_{14}$ are an unsubstituted alkyl group, a hydroxyalkyl group, an alkoxyalkyl group, a sulfonamidealkyl group, a sulfamoylalkyl group, and a sulfamoylaminoalkyl group. Examples of suitable include methyl, ethyl, hydroxymethyl, methanesulfonamidemethyl, 2-hydroxyethyl, 3-hydroxypropyl, 2,3-dihydroxypropyl, 2-sulfamoylethyl, 2-methoxyethyl, and methylaminosulfamoylmethyl. Most preferred examples of this alkyl group include an unsubstituted alkyl group, a hydroxyalkyl group, an alkoxyalkyl group, and a sulfonamidealkyl group.

Particularly preferred of compounds represented by the general formula (G) are those represented by the following general formula (H):

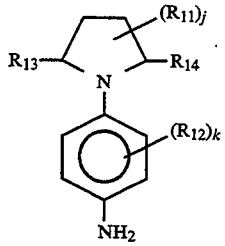

(H)

wherein $R_{11}$, $R_{12}$, $R_{13}$, $R_{14}$ and j are as defined above; and k represents an integer of 0 or 1.

Specific examples of typical developing agents represented by the general formula (E) of the present invention are shown given below but the present invention is not to be construed as being limited thereto.

(E)

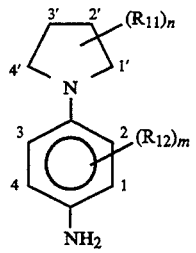

| Compound No. | $R_{12}$ Position 1- | 2- | 3- | 4- | $R_{11}$ Position 1'- | 2'- | 3'- | 4'- |
|---|---|---|---|---|---|---|---|---|
| E-1 | H | H | H | H | H | $-CH_2OH$ | H | H |
| E-2 | H | H | H | H | H | $-OH$ | H | H |
| E-3 | $-CH_3$ | H | H | H | H | $-CH_2NHSO_2CH_3$ | H | H |
| E-4 | $-CH_3$ | H | H | H | H | $-O(CH_2)_2OH$ | H | H |
| E-5 | $-CH_3$ | H | H | H | H | $-CONH_2$ | H | H |
| E-6 | H | H | H | H | H | $>C(CH_3)(CH_2OH)$ | H | H |
| E-7 | $-CH_3$ | H | H | H | $-CH_2OH$ | H | H | H |
| E-8 | $-CH_3$ | H | H | H | $-CH_2NHSO_2CH_3$ | H | H | H |
| E-9 | $-OCH_3$ | H | H | H | H | H | H | H |
| E-10 | $-CH_2OH$ | H | Cl | H | H | H | H | H |
| E-11 | H | H | H | H | H | $-N(CH_3)_2$ | H | H |
| E-12 | $-OH$ | H | H | H | H | $-CN$ | H | H |
| E-13 | H | $-OCH_3$ | H | H | H | $-NHCOCH_3$ | H | H |
| E-14 | $-C_2H_5$ | H | H | H | H | $-OH$ | H | H |
| E-15 | $-CH_2NHSO_2CH_3$ | H | H | H | H | $-CH_2NHCONH_2$ | H | H |
| E-16 | $-CH_3$ | H | H | H | H | $-NHSO_2CH_3$ | H | H |
| E-17 | $-NHCOOCH_3$ | H | H | H | $-CH_2O(CH_2)_2OH$ | H | H | H |
| E-18 | H | H | H | H | H | $-CH_2OH$ | $-CH_3$ | H |
| E-19 | $-N(CH_3)_2$ | H | H | H | H | $-NHCONH_2$ | H | H |
| E-20 | $-CH_2NHCH_3$ | H | H | H | H | $-(CH_2)_2OH$ | H | H |
| E-21 | $-CH_3$ | H | H | H | H | $-CH_2OH$ | H | H |
| E-22 | $-CH_3$ | H | H | H | H | $-OH$ | H | H |
| E-23 | $-C_2H_5$ | H | H | H | H | $-CH_2CONH_2$ | H | H |
| E-24 | $-CH_2NHCONH_2$ | H | H | H | $-CH_2OH$ | $-CH_3$ | H | H |
| E-25 | $-CH_3$ | H | H | H | H | H | H | H |
| E-26 | $-CH_3$ | H | H | H | H | $-NHCOOCH_3$ | H | H |
| E-27 | $-O(CH_2)_2OH$ | H | H | H | H | $-NHSO_2N(CH_3)_2$ | H | H |
| E-28 | $-C_2H_5$ | H | H | H | H | $-COOH$ | H | H |
| E-29 | $NHSO_2N(CH_3)_2$ | H | H | H | H | $-OH$ | H | H |
| E-30 | H | H | H | H | H | $-NHSO_2CH_3$ | H | H |
| E-31 | $-C_3H_7(i)$ | H | H | H | $-CH_2OH$ | H | H | $-CH_2OH$ |
| E-32 | $-(CH)_2OH$ | H | H | H | $-CH_2OH$ | H | H | $-CH_3$ |
| E-33 | $-(CH_2)_2NHSO_2CH_3$ | H | H | H | $-CH_3$ | $-OH$ | H | $-CH_3$ |
| E-34 | $-C_2H_5$ | H | H | H | $-CH_2OH$ | H | H | $-CH_2OH$ |
| E-35 | $-NHCON(CH_3)_2$ | H | H | H | $-CH_2NHCOCH_3$ | H | H | $-CH_3$ |
| E-36 | $-CH_3$ | H | H | H | $-CH_2NHSO_2CH_3$ | H | H | $-(CH_2)_2OH$ |
| E-37 | $-CH_3$ | H | H | H | $-CH_2OH$ | $-CH_2OH$ | H | $-CH_3$ |
| E-38 | $-CH_3$ | H | H | H | $-CH_3$ | $-CH_2OCH_3$ | H | $-CH_2OH$ |
| E-39 | $-CH_3$ | H | H | H | $-(CH_2)_2OH$ | H | H | $-CH_2OCH_3$ |
| E-40 | $-C_2H_5$ | H | H | H | $-(CH_2)_2OH$ | H | H | $-(CH_2)_2OH$ |
| E-41 | H | H | H | H | $-(CH_2)_3OH$ | H | H | $-(CH_2)_2OCH_3$ |
| E-42 | $-CH_3$ | H | H | H | $-CH_2NHCONH_2$ | H | H | $-CH_3$ |
| E-43 | $-CH_3$ | H | H | H | $-CH_3$ | H | H | $-CH_3$ |
| E-44 | $-CH_3$ | H | H | H | $-CH_2OH$ | H | H | $-CH_2OH$ |
| E-45 | H | H | H | H | $-CH_3$ | $-OH$ | H | $-CH_3$ |
| E-46 | $-OCH_3$ | H | H | H | $-CH_3$ | $-CH_2OH$ | H | $-CH_2OH$ |
| E-47 | H | $-OCH_3$ | H | H | $-CH_2NHSO_2CH_3$ | H | H | $-CH_3$ |
| E-48 | $-NHSO_2N(CH_3)_2$ | H | H | H | $-CH_3$ | $>C(CH_3)(OH)$ | H | $-CH_3$ |
| E-49 | $-OCH_3$ | H | Cl | H | $-CH_2OH$ | H | H | $-CH_3$ |
| E-50 | $-NHCOCH_3$ | H | H | H | $-CH_2CONH_2$ | H | H | $-CH_3$ |

($R_{11}$ is represented with one hydrogen atom omitted in any of the 1'- to 4'- positions except for di-substituted compounds.)

Compounds represented by the general formula (D) are preferred to those represented by the general formula (E).

The compound represented by the general formula (D) or (E) is very unstable when stored in the form of the free amine. Therefore, in a preferred embodiment, the compound represented by the general formula (D) or (E) is preferably prepared and stored in the form of organic acid salt or inorganic acid salt which is converted to the free amine for the first time when added to a processing solution. Examples of organic and inorganic acids which can be used for the preparation of the compound represented by the general formula (D) or (E) include hydrochloric acid, sulfuric acid, p-toluenesulfonic acid, methanesulfonic acid, and naphthalene-1,5-disulfonic acid. Preferred of these acids are sulfuric acid, and p-toluenesulfonic acid. Most preferred of these acids is sulfuric acid. For example, Compound D-12 can be obtained in the form of the sulfate salt, and its melting point is 112° C. to 114° C. (recrystallized from ethanol).

The amount of the color developing agent of the present invention which is used is preferably in the range of 0.1 g to 20 g, more preferably 1 g to 15 g, per l of developer.

The temperature at which color development is effected with the developer is from 20° C. to 50° C., preferably 30° C. to 45° C.

The color developing agent of the present invention can be easily synthesized in accordance with the methods as described in *Journal of the American Chemical Society,* vol. 3, page 3,100 (1951), and British Patent 807,899. Further, the methods as described in European Patent Disclosure No. 410450, and JP-A-4-11255 can be used.

The color developing agents of the present invention can be used alone or in combination. These color developing agents can be used in combination with other known p-phenylenediamine derivatives. Typical examples of known p-phenylenediamine derivatives which can be used in combination with these color developing agents are given below, but the present invention should not be construed as being limited thereto.

P-1: N,N-Diethyl-p-phenylenediamine
P-2: 2-Amino-5-(N,N-diethylamino)toluene
P-3: 2-Amino-5-(N-ethyl-N-laurylamino)toluene
P-4: 4-[N-ethyl-N-(β-hydroxyethyl)amino]aniline
P-5: 2-Methyl-4-[N-ethyl-N-(β-hydroxyethyl-)amino]aniline
P-6: 4-Amino-3-methyl-N-ethyl-N-[β-(methanesulfonamide)ethyl]aniline
P-7: N-(2-Amino-5-N,N-diethylaminophenylethyl)-methanesulfonamide
P-8: N,N-Dimethyl-p-phenylenediamine
P-9: 4-Amino-3-methyl-N-ethyl-N-methoxyethylaniline
P-10: 4-Amino-3-methyl-N-ethyl-N-β-ethoxyethylaniline
P-11: 4-Amino-3-methyl-N-ethyl-N-β-butoxyethylaniline Particularly preferred of these p-phenylenediamine derivatives are Compounds P-5 and P-6. These p-phenylenediamine derivatives are normally used in the salt form such as the sulfate, hydrochloride, p-toluenesulfonate, nitrate and naphthalene-1,5-disulfonate form. The amount of the aromatic primary amine developing agent to be used is preferably in the range of about 0.1 g to about 20 g per l of developer. The amount of other developing agents to be used in combination with the developing agent of the present invention is preferably in the range of 1/10 to 10 mol per mol so far as the effects of the present invention are impaired.

The color developer to be used in the present invention is normally alkaline and preferably is an alkaline aqueous solution halving a pH of 9 to 12.5.

The light-sensitive material comprising the yellow couplers represented by the general formulae (I), and (1) to (5) of the present invention and the cyan coupler represented by the general formula (D) can be processed with a color developer containing a color developing agent represented by the general formula (D) or (E) of the present invention to reduce the color development time and hence provide a rapid processing and give a color image with excellent dye fastness and image quality. Further, stable photographic properties can be obtained even if color development is effected with varying color development factors such as pH and temperature.

The light-sensitive material and color development process of the present invention are described hereinafter in greater detail.

The silver halide incorporated in the photographic emulsion layer in the photographic material used in the present invention is silver bromochloride or silver bromide having a silver bromide content of 80 mol % or more or silver bromoiodide, silver chloroiodide or silver bromochloroiodide having a silver iodide content of 40 mol % or less, preferably silver bromoiodide or silver bromo, chloroiodide having a silver iodide content of 0.1 to 40 mol %, a silver bromide content of 60 to 99.9 mol % and a silver chloride content of 0 to 5 mol %, particularly silver bromoiodide or silver bromochloroiodide having a silver iodide content of about 2 mol % to about 10 mol %.

Reference can be made to patents cited in European Patent 436,938A2 for techniques which can be used for the color photographic light-sensitive material of the present invention, inorganic and organic materials other than the above mentioned N,N-substituted malondiamide type couplers, cyan couplers represented by the general formula (C) and color developing agents represented by the general formulae (D) and (E), and color development process, as follows:

1. Layer Constitution: Line 34, p. 146–line 25, p. 147
2. Silver Halide Emulsions: Line 26, p. 147–line 12, p. 148
3. Yellow Couplers: Line 35, p. 137–line 33, p. 146, line 21–line 23, p. 149
4. Magenta Couplers: Line 24–line 28, p. 149; line 5, p. 3–line 55, p. 25 in European Patent 421,453A1
5. Cyan Couplers: Line 29–line 33, p. 149; line 28, p. 3–line 2, p. 40 in European Patent 432,804A2
6. Polymer Couplers: Line 34–line 38, p. 149; line 39, p. 113–line 37, p. 123 in European Patent 435,334A2
7. Colored Couplers: Line 42, p. 53–line 34, p. 137, line 39–line 45, p. 149
8. Other Functional Couplers: Line 1, p. 7–line 41, p. 53, line 46, p. 149–line 3, p. 150; line 1, p. 3–line 50, p. 29 in European Patent 435,334A2
9. Preservatives, Mildewproofing Agents: Line 25–line 28, p. 150
10. Formaldehyde Scavenger: Line 15–line 17, p. 149

11. Other Additives: Line 38–line 47, p. 153; line 21, p. 75–line 56, p. 84, line 40, p. 27–line 40, p. 37 in European Patent 421,453A1
12. Dispersion Method: Line 4–line 24, p. 150 13. Support: Line 32–line 34, p. 150
14. Film Thickness and Film Physical Properties: Line 35–line 49, p. 150
15. Color Development Process: Line 50, p. 150–line 47, p. 151
16. Desilvering Process: Line 48, p. 151–line 53, p.
17. Automatic Developing Machine: Line 54, p. 152–line 2, p. 153
18. Rinse, Stabilizing Process: Line 3–line 37, p. 153

The present invention can be applied to various color photographic materials. Typical examples of such color photographic materials include color negative films for ordinary use and for use in motion picture, color reversal films for slides and television, color papers, color positive films, and color reversal papers. Preferred of these color photographic materials are color negative films for ordinary use and for use in motion pictures, and color reversal films for slides and television.

Thus, the present invention is effective particularly for use in color photographic materials for picture taking having a large coated amount of silver (e.g., 3 to 10 g/m$^2$).

The present invention will be further described in the following examples, but the present invention is not to be construed as being limited thereto. Unless otherwise indicated herein, all parts, percents, ratios and the like are by weight.

EXAMPLE 1

On an undercoated cellulose triacetate film support was coated various layers having the compositions described below in the order starting with the first layer to prepare various samples.

The coated amount of coupler is represented in mol/m$^2$. The coated amount of gelatin, oil and film hardener is represented in g/m$^2$. The coated amount of silver halide is represented in g/m$^2$, calculated in terms of silver.

| | |
|---|---|
| First layer | |
| Silver bromoiodide emulsion (silver iodide content: 4 mol %; cubic grain; grain diameter: 0.5 μm as calculated in terms of a sphere) | 0.97 |
| Gelatin | 3.50 |
| Coupler (see Table 1 below) | $1.8 \times 10^{-3}$ |
| Oil (tricresyl phosphate) | Same as that of coupler |
| Second layer | |
| Gelatin | 1.30 |
| Film Hardener (sodium salt of 1-oxy-3,5-dichloro-s-triazine) | 0.12 |

The samples thus prepared with such a layer structure and the couplers used are set forth in Table 1 below. Samples 101 to 120 thus prepared were then evaluated using the following processing solutions in the following color development steps (Processing A).

Comparative Coupler (A) and Couplers (B), (C) and (D) set forth in Table 1 have the following chemical structures:

Comparative Coupler (A)
Coupler as disclosed in Research Disclosure 18053 (1979)

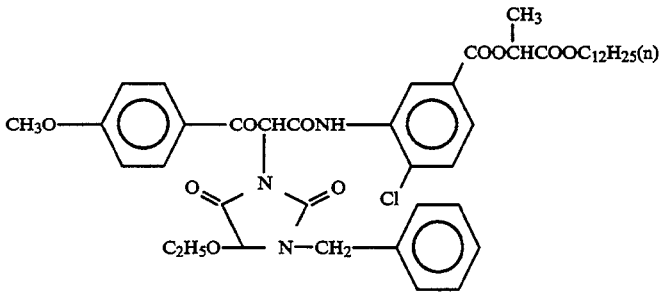

Coupler (B)
Compound (39) as disclosed in French Patent 1,558,452

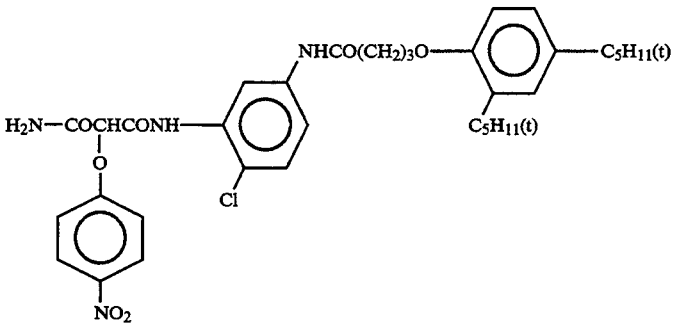

Coupler (C)
Compound (47) as disclosed in French Patent 1,558,452

-continued

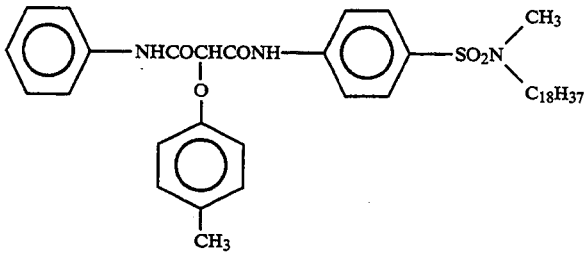

Coupler (D)
Compound Cp-(12) as disclosed in JP-A-1-250950

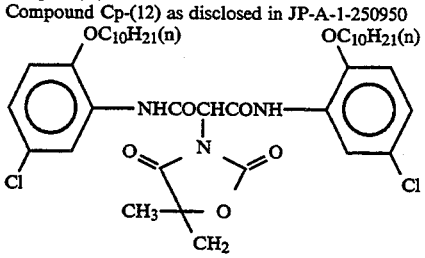

| Processing Step | Processing Time | Processing Temperature |
|---|---|---|
| Color development | 2 min. 15 sec. | 38° C. |
| Bleach | 3 min. 00 sec. | 38° C. |
| Rinse | 30 sec. | 24° C. |
| Fixing | 3 min. 00 sec. | 38° C. |
| Rinse (1) | 30 sec. | 24° C. |
| Rinse (2) | 30 sec. | 24° C. |
| Stabilization | 30 sec. | 38° C. |
| Drying | 4 min. 20 sec. | 55° C. |

The compositions of the various processing solutions are shown below.

| | (unit: g) |
|---|---|
| Color Developer | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-β-hydroxyethylamino]-2-methylaniline sulfate | 4.5 |
| Water to make | 1.0 l |
| pH | 10.05 |
| Bleaching Solution | |
| Ferric sodium ethylenediaminetetra-acetatetrihydrate | 100.0 |
| Disodium ethylenediaminetetraacetate | 10.0 |
| 3-Mercapto-1,2,4-triazole | 0.08 |
| Ammonium bromide | 140.0 |
| Ammonium nitrate | 30.0 |
| 27% Aqueous ammonia | 6.5 ml |
| Water to make | 1.0 l |
| pH | 6.0 |
| Fixing Solution | |
| Disodium ethylenediaminetetraacetate | 0.5 |
| Ammonium sulfite | 20.0 |
| Aqueous solution of ammonium thiosulfate (700 g/l) | 290.0 ml |
| Water to make | 1.0 l |
| pH | 6.7 |
| Stabilizing Solution | |
| Sodium p-toluenesulfinate | 0.03 |
| Polyoxyethylene-p-monononylphenylether (average polymerization degree: 10) | 0.2 |
| Disodium ethylenediaminetetraacetate | 0.05 |
| 1,2,4-Triazole | 1.3 |
| 1,4-Bis(1,2,4-triazole-1-ilmethyl)-piperazine | 0.75 |
| Water to make | 1.0 l |
| pH | 8.5 |

The properties were evaluated as follows:

(1) Coloring Properties

The samples were gradation-wise exposed to white light, subjected to the above described processing, and then the density was measured. The maximum ultimate density (Dmax) was read from the characteristic curve.

(2) Colored Image Fastness

The samples were gradation-wise exposed to white light, subjected to the above described processing, and then the density was measured. These samples were stored at a temperature of 60° C. and 70% RH for 2 months, and then again the density was measured. The density was then measured at the point at which the density had been 1.5 before the test to determine the percent dye remaining (%).

(3) Image Quality

The samples were gradation-wise exposed to white light, and then subjected to the above described processing. The B density and G density of the yellow image thus obtained was then measured. The G density was read at the exposure which gives a B density of 2.0. The G density at the minimum B density (Dmin) was subtracted from the above described G density to determine color stain as a measure of color reproducibility. The smaller this value is, the less is the absorption in the green range by the yellow dye and hence the better is the saturation.

The results obtained are set forth in Table 1 below.

TABLE 1

| | | Properties | | | | | | | | | | | | | | |
|---|---|---|---|---|---|---|---|---|---|---|---|---|---|---|---|---|
| | | Coloring Properties (Dmax) | | | | | Colored Image Fastness (60° C., 70% RH) | | | | | Color Stain | | | | |
| | | Processing Method | | | | | | | | | | | | | | |
| Sample | Coupler | A* (2'15") | B** (1'30") D-12 | C** (1'30") D-20 | D** (1'30") E-40 | E** (1'30") E-5 | A* (2'15") | B** (1'30") D-12 | C** (1'30") D-20 | D** (1'30") E-40 | E** (1'30") E-5 | A* (2'15") | B** (1'30") D-12 | C** (1'30") D-20 | D** (1'30") E-40 | E** (1'30") E-5 |
| 101 | Comparative Coupler (A) | 100 (Reference) | 102 | 102 | 101 | 101 | 72 | 73 | 73 | 72 | 72 | 0.12 | 0.11 | 0.11 | 0.12 | 0.12 |
| 102 | Y-9 | " | 107 | 107 | 107 | 107 | 90 | 97 | 97 | 95 | 94 | 0.06 | 0.02 | 0.02 | 0.02 | 0.02 |
| 103 | Coupler (B) | " | 103 | 103 | 102 | 102 | 65 | 71 | 71 | 68 | 67 | 0.14 | 0.10 | 0.10 | 0.11 | 0.11 |
| 104 | Y-21 | " | 106 | 106 | 105 | 105 | 89 | 96 | 96 | 94 | 93 | 0.05 | 0.01 | 0.01 | 0.01 | 0.01 |
| 105 | Coupler (C) | " | 104 | 104 | 103 | 103 | 66 | 72 | 72 | 70 | 69 | 0.13 | 0.09 | 0.09 | 0.10 | 0.10 |
| 106 | Y-1 | " | 105 | 105 | 104 | 104 | 85 | 91 | 91 | 90 | 89 | 0.08 | 0.04 | 0.04 | 0.04 | 0.04 |
| 107 | Y-3 | " | 107 | 107 | 106 | 106 | 90 | 97 | 97 | 96 | 96 | 0.05 | 0.01 | 0.01 | 0.01 | 0.01 |
| 108 | Y-6 | " | 107 | 107 | 107 | 107 | 89 | 96 | 96 | 95 | 95 | 0.06 | 0.02 | 0.02 | 0.02 | 0.02 |
| 109 | Coupler (D) | " | 105 | 105 | 104 | 104 | 77 | 83 | 83 | 82 | 81 | 0.13 | 0.09 | 0.09 | 0.10 | 0.10 |
| 110 | Y-2 | 100 (Reference) | 105 | 105 | 104 | 104 | 83 | 91 | 91 | 90 | 89 | 0.08 | 0.04 | 0.04 | 0.04 | 0.04 |
| 111 | Y-5 | " | 107 | 107 | 107 | 107 | 90 | 97 | 97 | 96 | 96 | 0.06 | 0.02 | 0.02 | 0.02 | 0.02 |
| 112 | Y-18 | " | 107 | 107 | 106 | 106 | 89 | 96 | 96 | 95 | 95 | 0.06 | 0.02 | 0.02 | 0.02 | 0.02 |
| 113 | Y-22 | " | 106 | 106 | 105 | 105 | 88 | 95 | 95 | 94 | 94 | 0.06 | 0.02 | 0.02 | 0.02 | 0.02 |
| 114 | Y-7 | " | 107 | 107 | 107 | 107 | 89 | 96 | 96 | 95 | 95 | 0.06 | 0.02 | 0.02 | 0.02 | 0.02 |
| 115 | Y-13 | " | 107 | 107 | 107 | 107 | 88 | 95 | 95 | 94 | 94 | 0.06 | 0.02 | 0.02 | 0.02 | 0.02 |
| 116 | Y-14 | " | 107 | 107 | 106 | 106 | 89 | 96 | 96 | 95 | 95 | 0.05 | 0.01 | 0.01 | 0.01 | 0.01 |
| 117 | Y-15 | " | 107 | 107 | 107 | 107 | 89 | 96 | 96 | 95 | 95 | 0.06 | 0.02 | 0.02 | 0.02 | 0.02 |
| 118 | Y-18 | " | 107 | 107 | 106 | 106 | 90 | 97 | 97 | 96 | 96 | 0.05 | 0.01 | 0.01 | 0.01 | 0.01 |
| 119 | Y-19 | " | 107 | 107 | 106 | 106 | 90 | 97 | 97 | 96 | 96 | 0.05 | 0.01 | 0.01 | 0.01 | 0.01 |

*Comparative
**Present invention

Items in [ ] are according to the present invention

Processing Methods B, C, D and E were effected in the same manner as Processing Method A, except that 4-[N-ethyl-N-B-hydroxyethylamino]-2-methylaniline sulfate incorporated in the color developer as a color developing agent was replaced by developing agents of the present invention represented by the general formulae (D) and (E), i.e., Developing Agents D-12, D-20, E-40 and E-5, in equimolecular amounts, respectively, and the color development time was reduced from 2 minutes and 15 seconds to 1 minute and 30 seconds.

Another batch of previously prepared samples were subjected to the same exposure as conducted above, subjected to Processing Methods B to E, and then properties (1) to (3) were evaluated. For the coloring properties (Dmax) (1), Dmax of a sample after the Processing Methods A to E were represented in percentage (%) relative to that of the same sample after Processing Method A as 100.

The results obtained are set forth in Table 1 above.

It can be seen from the results in Table 1 that when Samples 102 to 119, which comprise the yellow coupler represented by the general formula (I), are processed with color developers containing Developing Agents D-12, D-20, E-40 and E-5 of the present invention represented by the general formula (D) or (E) in the processing methods B to E, they exhibit an excellent colored image fastness and a remarkable effect in inhibiting color stain despite the reduction of the color development time from 2 minutes and 15 seconds to 1 minute and 30 seconds as compared with the same samples which had been subjected to Processing Method A.

It can also be seen that Samples 102 to 119 exhibit a remarkable effect of inhibiting color stain and a great effect of improving colored image fastness as compared with Comparative. Sample 101.

Referring to the yellow coupler of the present invention represented by the general formula (I), it can be seen that Samples 102, 104, 106, 107, 108, and 110 to 119, which comprise the coupler represented by the general formula (1) or (2), have excellent coloring properties, colored image fastness and color stain as compared with Samples 103, 105 and 109, which comprise the exemplary couplers. It can be seen in the comparison between Sample 106 and Sample 107 and between Sample 110 and Samples 111 to 113 that even in the couplers of the present invention represented by the general formula (4) or (5), the couplers represented by the general formula (4) or (5) have excellent properties as compared with the coupler represented by the general formula (3) and thus are most preferable.

EXAMPLE 2

Samples 101 to 119 as prepared in Example 1 were processed with the same processing solutions using the same processing procedure as in Example 1, except that Processing Methods A and B employing different color developing agents from those of Example 1 were used and the color development time was altered as set forth in Table 2 below.

The density of the color images thus obtained was then measured. From these measurements, the maximum ultimate density (Dmax) was determined. The results obtained are set forth in Table 2 below.

The Dmax of a sample was represented as a percentage (%) relative to that of the same sample which has been subjected to color development for the longest time, i.e., 2 minutes and 30 seconds, as 100.

TABLE 2

| Sample | Color Development Time | | | | | | | | | |
|---|---|---|---|---|---|---|---|---|---|---|
| | Processing Method A | | | | | Processing Method B | | | | |
| No. | 50" | 1'10" | 1'30" | 2'00" | 2'30" | 50" | 1'10" | 1'30" | 2'00" | 2'30" |
| 101 | 79 (reference) | 90 | 96 | 99 | 100 | 84 | 95 | 99 | 100 | 100 (reference) |
| 102 | 84 | 93 | 97 | 100 | " | 97 | 100 | 100 | 100 | " |
| 103 | 68 | 85 | 93 | 97 | " | 91 | 97 | 100 | 100 | " |
| 104 | 81 | 91 | 96 | 99 | " | 95 | 99 | 100 | 100 | " |
| 105 | 72 | 87 | 94 | 98 | " | 93 | 98 | 100 | 100 | " |
| 106 | 76 | 89 | 95 | 98 | " | 94 | 99 | 100 | 100 | " |
| 107 | 84 | 93 | 97 | 100 | " | 97 | 100 | 100 | 100 | " |
| 108 | 86 | 94 | 97 | 100 | " | 97 | 100 | 100 | 100 | " |
| 109 | 75 | 88 | 95 | 98 | " | 94 | 99 | 100 | 100 | " |
| 110 | 75 | 88 | 95 | 98 | " | 94 | 99 | 100 | 100 | " |
| 111 | 84 | 93 | 97 | 100 | " | 97 | 100 | 100 | 100 | " |
| 112 | 83 | 92 | 97 | 100 | " | 97 | 100 | 100 | 100 | " |
| 113 | 82 | 92 | 97 | 100 | " | 96 | 99 | 100 | 100 | " |
| 114 | 86 | 94 | 97 | 100 | " | 97 | 100 | 100 | 100 | " |
| 115 | 85 | 94 | 97 | 100 | " | 97 | 100 | 100 | 100 | " |
| 116 | 84 | 93 | 97 | 100 | " | 97 | 100 | 100 | 100 | " |
| 117 | 86 | 94 | 97 | 100 | " | 97 | 100 | 100 | 100 | " |
| 118 | 83 | 92 | 97 | 100 | " | 97 | 100 | 100 | 100 | " |
| 119 | 84 | 93 | 97 | 100 | " | 97 | 100 | 100 | 100 | " |

(Sample 102 to 119 which have been subjected to Processing Method B are according the present invention)

Items in [ ] are according to the present invention.

It is obvious from the results in Table 2 that when Samples 102 to 119, which meet the requirements of the present invention, are subjected to Processing Method B, color development proceeds rapidly and the color development time required to reach the maximum ultimate density is short.

It is also seen that even Comparative Sample 101 undergoes rapid color development but reaches the maximum ultimate density more slowly than Samples 102 to 119.

It can further be seen from a comparison between Samples 102 to 119 that even with the yellow couplers of the present invention represented by the general formula (I), as in the results of Example 1, the couplers represented by the general formula (1) or (2) are preferred, and the couplers represented by the general formula (4) or (5) are preferred to those represented by the general formula (3) and provide the most preferred color development progress.

EXAMPLE 3

Samples 101 to 115 as prepared in Example 1 were subjected to the same processing method as Processing Method B with the same color developer as used in Example 1, except that the amount of the color developing agent D-12 added, the temperature and pH at which the color developer is used were altered as set forth in Table 3 below, and the color development time was accordingly altered as set forth in Table 3.

The density of the samples thus processed was measured for density to obtain their characteristic curves. From these characteristic curves, the maximum ultimate density (Dmax) was determined in the same manner as in Example 1.

TABLE 3

| Processing Method | Color Development Time | Color Development Temperature | pH of Color Developer | Amount of Color Developing Agent (molar ratio) |
|---|---|---|---|---|
| F | 1 min. 30 sec. | 38° C. | 10.05 | 1.0 (as used in Example 1) |
| G | 1 min. 00 sec. | 41° C. | 10.05 | 1.0 |
| H | 1 min. 00 sec. | 38° C. | 10.05 | 1.5 |
| I | 1 min. 10 sec. | 38° C. | 10.25 | 1.0 |

Among samples 101 to 115, relative Dmax of each Samples 106, 107, 111, 113 and 114 were evaluated with respect to Dmax obtained by the Processing Method B in Example 1, wherein the color development time was 2 min. 30 sec., as 100. The relative Dmax of these samples are shown in Table 4 below.

TABLE 4

| Sample No. | Processing Method F | G | H | I |
|---|---|---|---|---|
| 106 (Y-1) | 100 (reference) | 100 | 101 | 98 |
| 107 (Y-3) | 100 (reference) | 100 | 101 | 100 |
| 111 (Y-5) | 100 (reference) | 101 | 101 | 100 |
| 113 (Y-22) | 100 (reference) | 101 | 101 | 100 |
| 114 (Y-7) | 100 (reference) | 101 | 101 | 100 |

It is obvious from the results in Table 4 above that the light-sensitive materials comprising the yellow couplers of the present invention represented by the general formula (1) or (2) exhibit a sufficient color density even when processed with color developers containing different amounts of the color developing agent D-12 used in the present invention at different color development temperatures and different pH's. It is also seen that these processing methods enable a reduction in the color development time and hence can expedite color development.

EXAMPLE 4

On an undercoated cellulose triacetate film support were coated various layers having the following compositions to prepare a multi-layer color photographic light-sensitive material as Sample 401.

Composition of Light-Sensitive Layer

The materials used in the various layers are designated as follows:

ExC: cyan coupler
ExM: magenta coupler
ExY: yellow coupler
ExS: sensitizing dye
UV: ultraviolet absorbent
HBS: high boiling organic solvent
H: gelatin hardener The coated amount of silver halide and colloidal silver is represented in g/m$^2$, calculated in terms of silver. The coated amount of coupler, additive and gelatin is represented in g/m$^2$. The coated amount of sensitizing dye is represented as the molar amount thereof per mole of silver halide present in the same layer.

| | |
|---|---|
| First Layer: antihalation layer | |
| Black colloidal silver | 0.20 |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| HBS-1 | 0.30 |
| HBS-2 | $1.2 \times 10^{-2}$ |
| Second Layer: interlayer | |
| Finely divided silver bromoiodide grains (AgI content: 1.0 mol %; grain diameter: 0.07 μm as calculated in terms of sphere) | 0.15 (in terms of silver) |
| Gelatin | 1.00 |
| ExC-4 | $6.0 \times 10^{-2}$ |
| Cpd-3 | $2.0 \times 10^{-2}$ |
| Third Layer: low sensitivity red-sensitive emulsion layer | |
| Silver bromoiodide emulsion A | 0.42 (in terms of silver) |
| Silver bromoiodide emulsion B | 0.04 (in terms of silver) |
| Gelatin | 1.20 |
| ExS-1 | $6.8 \times 10^{-4}$ mol |
| ExS-2 | $2.2 \times 10^{-4}$ mol |
| ExS-3 | $6.0 \times 10^{-5}$ mol |
| C-4 | 0.65 |
| ExC-3 | $1.0 \times 10^{-2}$ |
| ExC-4 | $2.3 \times 10^{-2}$ |
| HBS-1 | 0.02 |
| HBS-4 | 0.12 |
| Fourth Layer: middle sensitivity red-sensitive emulsion layer | |
| Silver bromoiodide emulsion C | 0.85 (in terms of silver) |
| Gelatin | 0.75 |
| ExS-1 | $4.5 \times 10^{-4}$ mol |
| ExS-2 | $1.5 \times 10^{-4}$ mol |
| ExS-3 | $4.5 \times 10^{-5}$ mol |
| C-4 | 0.13 |
| C-10 | $6.2 \times 10^{-2}$ |
| ExC-3 | $2.0 \times 10^{-2}$ |
| ExC-4 | $4.0 \times 10^{-2}$ |
| ExC-6 | $3.0 \times 10^{-2}$ |
| HBS-1 | 0.10 |
| Fifth Layer: high sensitivity red-sensitive emulsion layer | |
| Silver bromoiodide emulsion D | 1.50 (in terms of silver) |
| Gelatin | 1.20 |
| ExS-1 | $3.0 \times 10^{-4}$ mol |
| ExS-2 | $9.0 \times 10^{-5}$ mol |
| ExS-3 | $3.0 \times 10^{-5}$ mol |
| C-10 | $8.5 \times 10^{-2}$ |
| ExC-3 | $1.0 \times 10^{-2}$ |
| ExC-5 | $3.6 \times 10^{-2}$ |
| ExC-6 | $1.0 \times 10^{-2}$ |
| ExC-7 | $3.7 \times 10^{-2}$ |
| HBS-7 | 0.12 |
| HBS-2 | 0.12 |
| Sixth Layer: interlayer | |

-continued

| | |
|---|---|
| Gelatin | 1.00 |
| Cpd-4 | $8.0 \times 10^{-2}$ |
| HBS-1 | $8.0 \times 10^{-2}$ |
| Seventh Layer: low sensitivity green-sensitive emulsion layer | |
| Silver bromoiodide emulsion E | 0.28 (in terms of silver) |
| Silver bromoiodide emulsion F | 0.16 (in terms of silver) |
| Gelatin | 0.85 |
| ExS-4 | $7.5 \times 10^{-4}$ mol |
| ExS-5 | $3.0 \times 10^{-4}$ mol |
| ExS-6 | $1.5 \times 10^{-4}$ mol |
| ExM-1 | 0.50 |
| ExM-2 | 0.10 |
| ExM-5 | $3.5 \times 10^{-2}$ |
| HBS-1 | 0.20 |
| HBS-3 | $3.0 \times 10^{-2}$ |
| Eigth Layer: middle sensitivity green-sensitive emulsion layer | |
| Silver bromoiodide emulsion G | 0.57 (in terms of silver) |
| Gelatin | 0.36 |
| ExS-4 | $5.2 \times 10^{-4}$ mol |
| ExS-5 | $2.1 \times 10^{-4}$ mol |
| ExS-6 | $1.1 \times 10^{-5}$ mol |
| ExM-1 | 0.12 |
| ExM-2 | $7.1 \times 10^{-3}$ |
| ExM-3 | $3.5 \times 10^{-2}$ |
| HBS-1 | 0.10 |
| HBS-3 | $1.0 \times 10^{-2}$ |
| HBS-4 | 0.10 |
| Nineth Layer: interlayer | |
| Gelatin | 0.50 |
| HBS-1 | $2.0 \times 10^{-2}$ |
| Tenth Layer: high sensitivity green-sensitive emulsion layer | |
| Silver bromoiodide emulsion H | 1.30 (in terms of silver) |
| Gelatin | 1.00 |
| ExS-4 | $3.0 \times 10^{-4}$ mol |
| ExS-5 | $1.2 \times 10^{-4}$ mol |
| ExS-6 | $1.2 \times 10^{-4}$ mol |
| ExS-4 | $5.8 \times 10^{-2}$ |
| ExM-6 | $5.0 \times 10^{-3}$ |
| C-10 | $4.5 \times 10^{-3}$ |
| Comparative Coupler (a) | $1.0 \times 10^{-2}$ |
| Cpd-5 | $1.0 \times 10^{-2}$ |
| Cpd-8 | $3.0 \times 10^{-2}$ |
| HBS-1 | 0.20 |
| HBS-4 | 0.10 |
| Eleventh Layer: yellow filter layer | |
| Gelatin | 0.50 |
| Cpd-6 | $5.2 \times 10^{-2}$ |
| HBS-1 | 0.12 |
| Twelfth Layer: interlayer | |
| Gelatin | 0.45 |
| Cpd-3 | 0.10 |
| Thirteenth Layer: low sensitivity blue-sensitive emulsion layer | |

-continued

| | |
|---|---|
| Silver bromoiodide emulsion I | 0.20 (in terms of silver) |
| Gelatin | 0.80 |
| ExS-7 | $3.0 \times 10^{-4}$ mol |
| Comparative coupler (A) | 0.66 |
| Comparative coupler (a) | $3.2 \times 10^{-2}$ |
| HBS-1 | 0.20 |
| Fourteenth Layer: middle sensitivity blue-sensitive emulsion layer | |
| Silver bromoiodide emulsion J | 0.19 (in terms of silver) |
| Gelatin | 0.35 |
| ExS-7 | $3.0 \times 10^{-4}$ mol |
| Comparative coupler (A) | 0.24 |
| Comparative coupler (a) | $1.5 \times 10^{-2}$ |
| HBS-1 | $8.0 \times 10^{-2}$ |
| Fifteenth Layer: interlayer | |
| Finely divided silver bromoiodide grains (AgI content: 2 mol %; uniform AgI type; grain diameter: 0.13 μm as calculated in terms of sphere) | 0.20 (in terms of silver) |
| Gelatin | 0.36 |
| Sixteenth Layer: high sensitivity blue-sensitive emulsion layer | |
| Silver bromoiodide emulsion K | 1.55 (in terms of silver) |
| Gelatin | 0.80 |
| ExS-8 | $2.2 \times 10^{-4}$ mol |
| Comparative coupler (A) | 0.23 |
| Comparative coupler (a) | $1.0 \times 10^{-2}$ |
| HBS-1 | $7.0 \times 10^{-2}$ |
| HBS-4 | $3.0 \times 10^{-2}$ |
| Seventeenth Layer: 1st protective layer | |
| Gelatin | 1.80 |
| UV-1 | 0.13 |
| UV-2 | 0.21 |
| HBS-1 | $1.0 \times 10^{-2}$ |
| HBS-2 | $1.0 \times 10^{-2}$ |
| Eighteenth Layer: 2nd protective layer | |
| Finely divided silver chloride grains (grain diameter: 0.07 μm as calculated in terms of sphere) | 0.36 (in terms of silver) |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

In addition to these components, 1,2-benzisothiazoline-3-one (200 ppm on the average based on gelatin), n-butyl-p-hydroxybenzoate (about 1,000 ppm on the average based on gelatin), and 2-phenoxyethanol (about 10,000 ppm on the average based on gelatin) were incorporated in these samples. Further, B-4, B-5, B-6, W-2, W-3, W-4, F-1 to F-15, iron salts, lead salts, gold salts, platinum salts, iridium salts, rhodium salts, and palladium salts were incorporated in these samples.

TABLE 5

| Emulsion No. | Mean AgI Content (%) | Diameter in Terms of a Sphere (μm) | Grain Diameter Fluctuation (%) | Mean Diameter in Terms of a Sphere (μm) | Mean Thickness (μm) | Grain Structure | Crystal Form |
|---|---|---|---|---|---|---|---|
| A | 9 | 0.75 | 18 | 1.16 | 0.21 | Triple structure | Tabular |
| B | 3 | 0.50 | 10 | 0.50 | 0.50 | Triple structure | Cubic |
| C | 9 | 0.83 | 15 | 1.32 | 0.22 | Triple structure | Tabular |
| D | 5 | 1.20 | 15 | 1.90 | 0.32 | Triple structure | Tabular |
| E | 5 | 0.70 | 18 | 1.13 | 0.18 | Triple structure | Tabular |
| F | 3 | 0.48 | 10 | 0.48 | 0.48 | Triple structure | Octahedral |
| G | 7 | 0.80 | 15 | 1.25 | 0.22 | Triple structure | Tabular |
| H | 4.5 | 1.15 | 15 | 1.97 | 0.26 | Triple structure | Tabular |

TABLE 5-continued

| Emulsion No. | Mean AgI Content (%) | Diameter in Terms of a Sphere (μm) | Grain Diameter Fluctuation (%) | Mean Diameter in Terms of a Sphere (μm) | Mean Thickness (μm) | Grain Structure | Crystal Form |
|---|---|---|---|---|---|---|---|
| I | 1.5 | 0.55 | 20 | 0.90 | 0.14 | Triple structure | Tabular |
| J | 8 | 0.80 | 16 | 1.19 | 0.24 | Triple structure | Tabular |
| K | 7 | 1.45 | 14 | 2.31 | 0.38 | Triple structure | Tabular |

In Table 5, (1) The various emulsions were subjected to reduction sensitization with thiourea dioxide and thiosulfonic acid during the preparation of grains in accordance with the example described in JP-A-2-191938;

(2) The various emulsions were subjected to gold sensitization, sulfur sensitization and selenium sensitization in the presence of the spectral sensitizing dyes as described with reference to the various light- sensitive layers and sodium thiocyanate in accordance with the example described in JP-A-3-237450;

(3) In the preparation of tabular grains, a low molecular weight gelatin was used in accordance with the example described in JP-A-1-158426; and (4) Tabular grains and regular grains having a grain structure were observed under high voltage electron microscope to have a transition line as described in JP-A-3-237450.

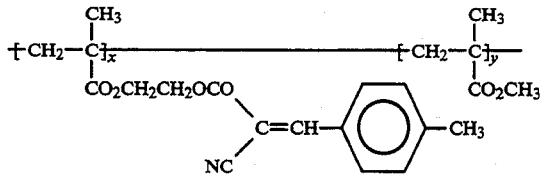

UV-1 x/y = 7/3 (weight ratio)

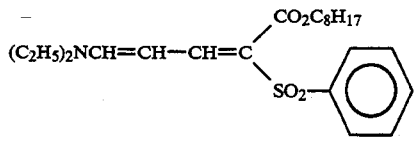

UV-2

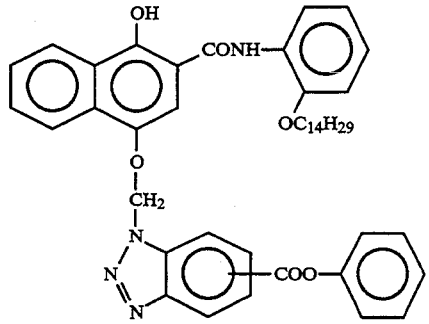

ExC-3

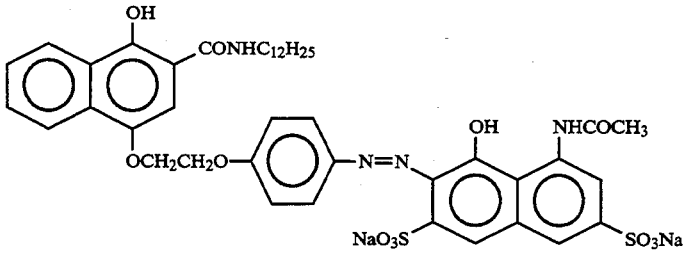

ExC-4

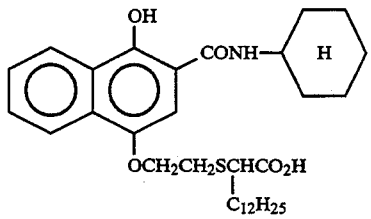

ExC-5

-continued
ExC-6
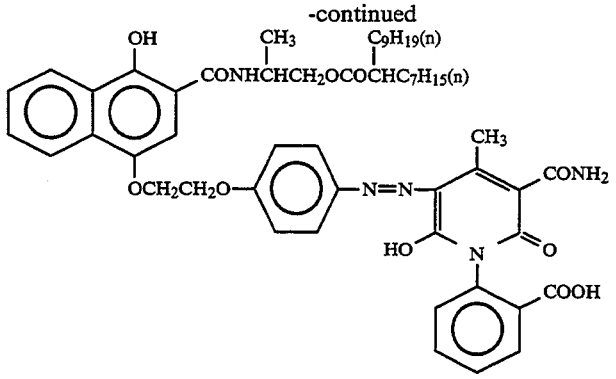
ExC-7
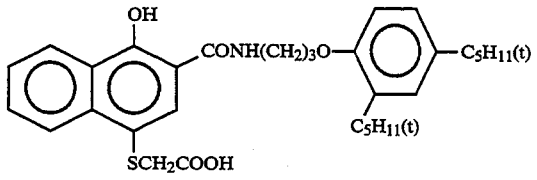
ExM-1
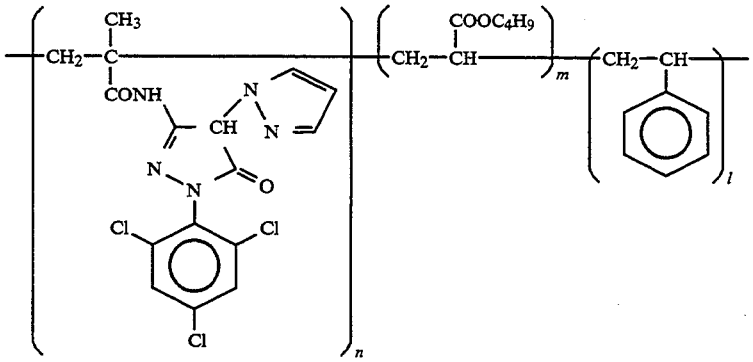
n:m:l = 2:1:1
(weight ratio)
Mean molecular weight:
20,000
ExM-2
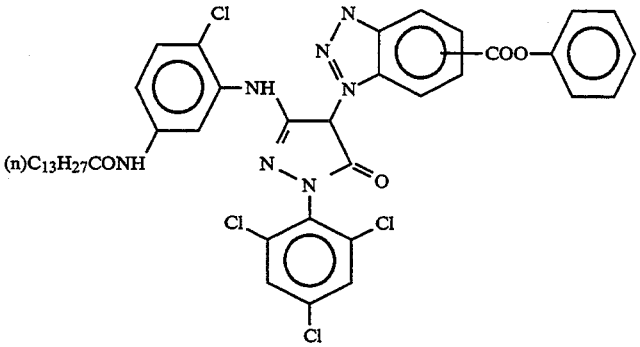
ExM-3
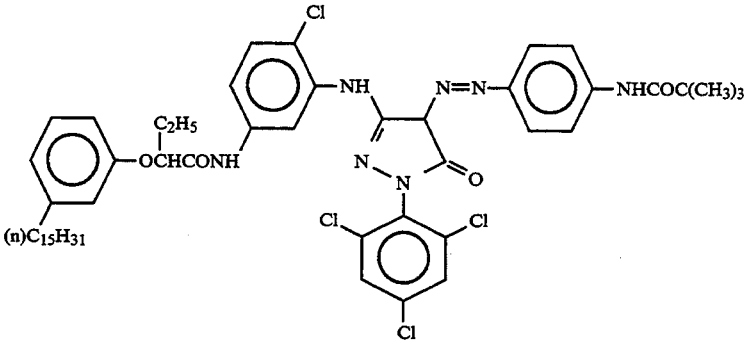

-continued
ExM-4
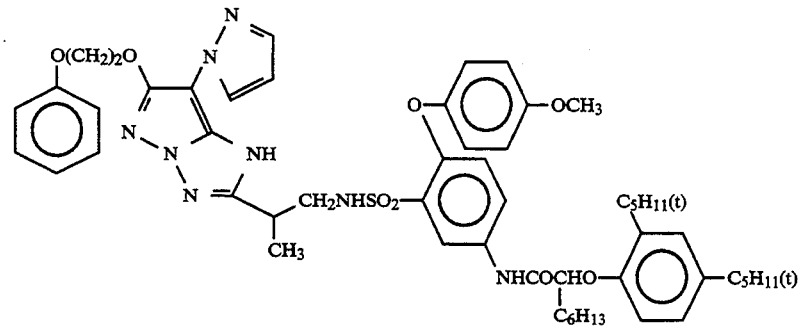
ExM-5
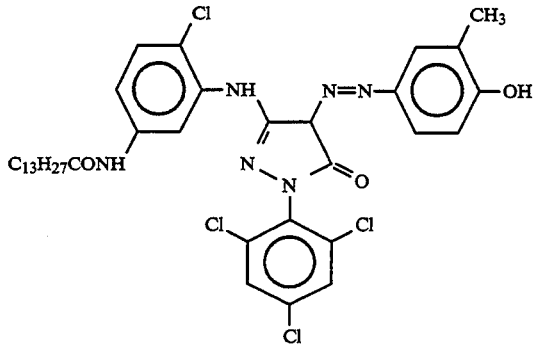
ExM-6
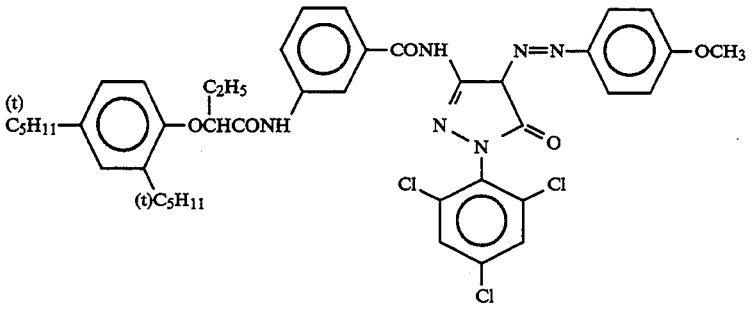
Cpd-1
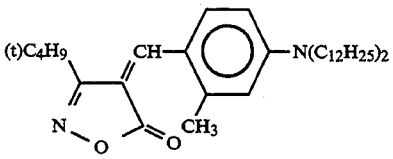
Cpd-2
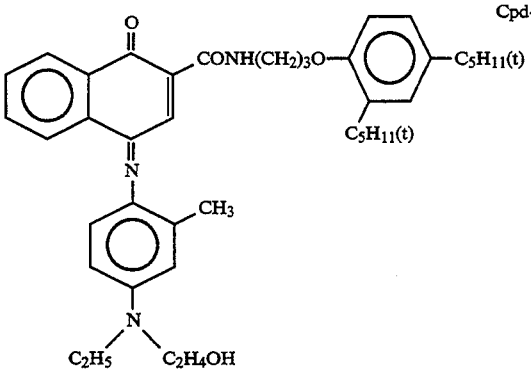
Cpd-3
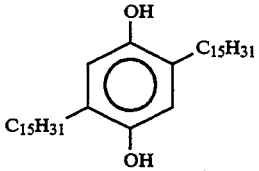
Cpd-4
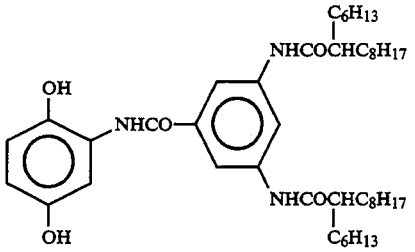

-continued
Cpd-5
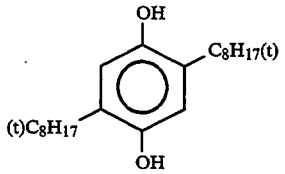
Cpd-6
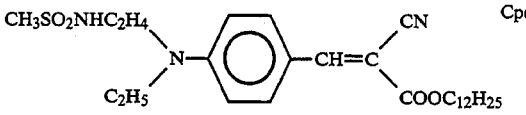
1:1 mixture (weight ratio) of:
Cpd-7
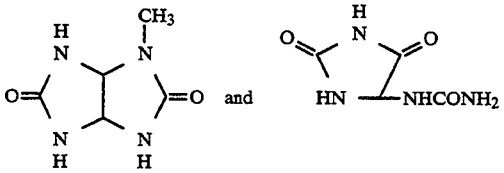
Cpd-8
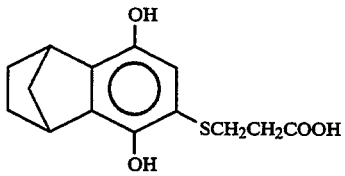
HBS-1
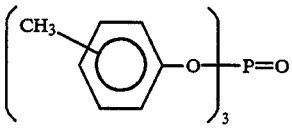
HBS-2
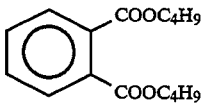
HBS-3
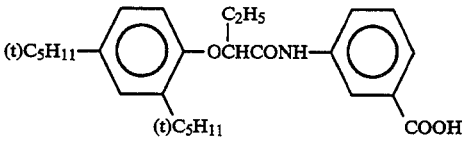
HBS-4
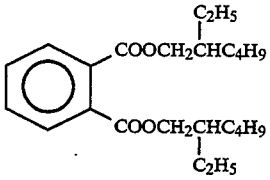
ExS-1
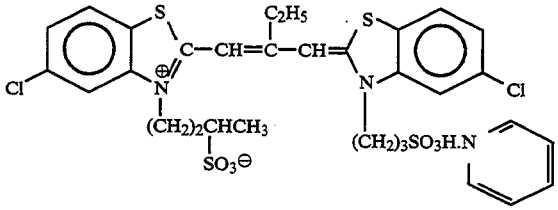
ExS-2
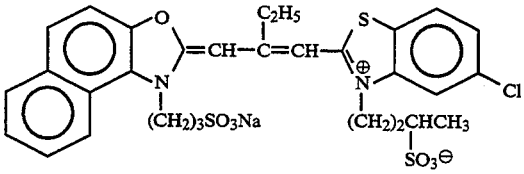
ExS-3
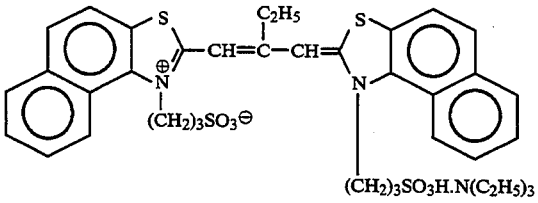
ExS-4
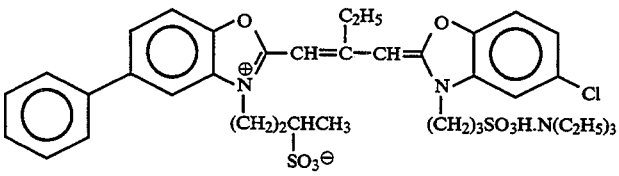

-continued
ExS-5
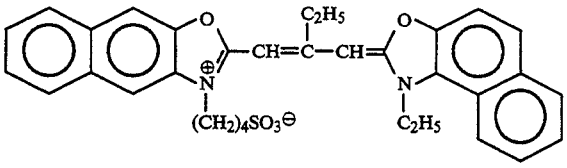
ExS-6
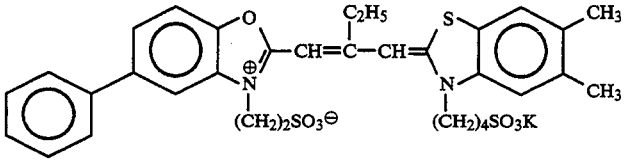
ExS-7
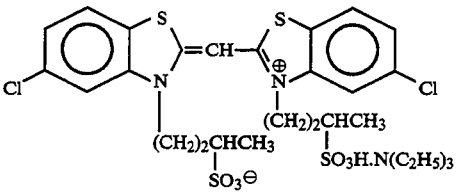
ExS-8
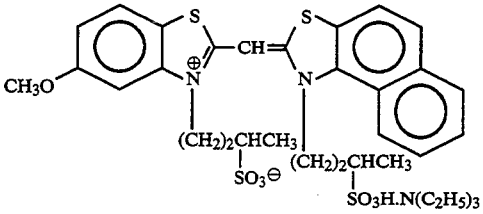
B-1
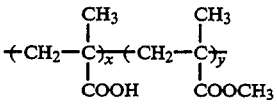
x/y = 10/90
B-2
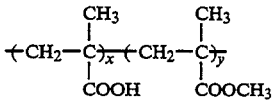
x/y = 40/60
B-3
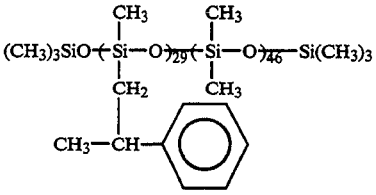
B-4
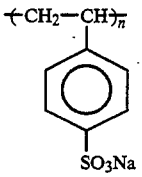
B-5
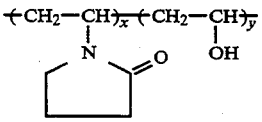
x/y = 70/30
B-6
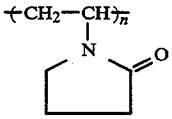
(mol. wt. about 10,000)
W-1
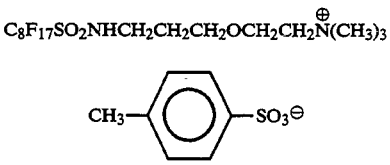
W-2
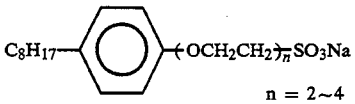
n = 2~4
W-3
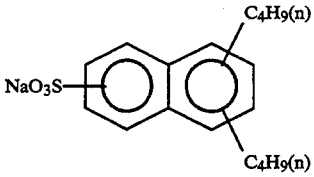
W-4
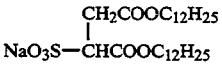
H-1
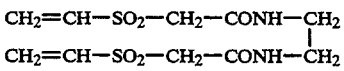
F-1
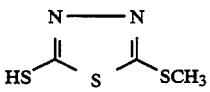

-continued

F-2

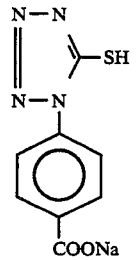

F-3

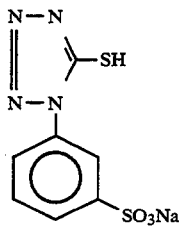

F-4

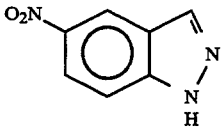

F-5

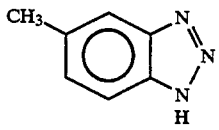

F-6

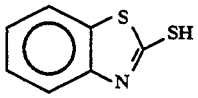

F-7

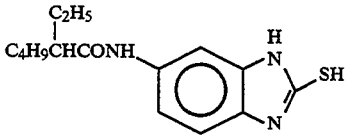

F-8

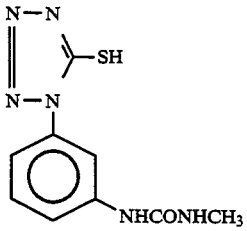

F-9

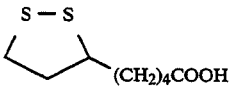

F-10

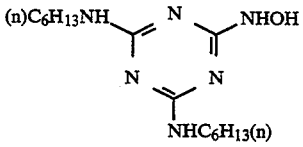

F-11

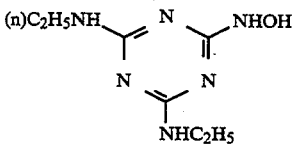

F-12

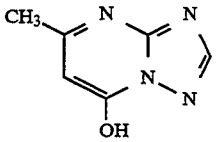

F-13

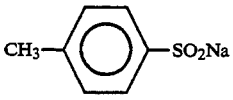

F-14

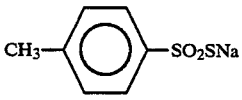

F-15

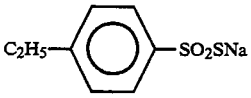

Samples 402 to 408 were prepared in the same manner as Sample 401, except that Comparative Couplers (A) and (a) incorporated in the Tenth Layer, Thirteenth Layer, Fourteenth Layer and Sixteenth Layer and the cyan couplers C-4 and C-10 to be incorporated in the Third Layer, Fourth Layer, Fifth Layer, and Tenth Layer were replaced by the couplers of the present invention represented by the general formula (1) or (2) or other couplers or comparative couplers represented by the general formula (C) in the equimolecular amounts as described in Table 6 below. The comparative couplers and other exemplary couplers used have the following chemical structures:

Comparative Coupler (A)
Same as Comparaive Coupler (A) used in Example 1,
(Disclosed in Research Disclosure 18053 (1979))

-continued

Comparative Coupler (a)

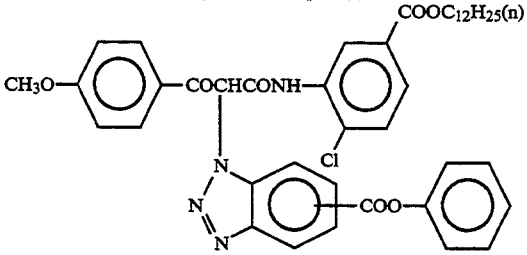

Coupler (b)
Compound (I-12) as described in JP-A-2-250053

-continued

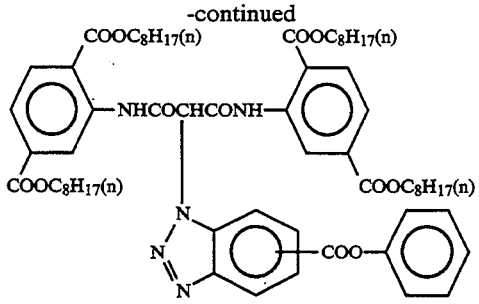

Coupler (c)
Compound (6) as described in JP-A-52-69624

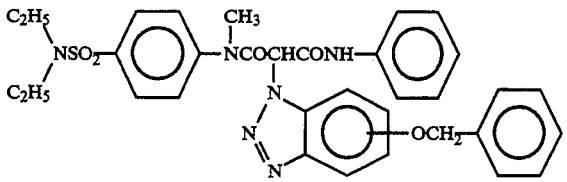

Coupler (d)
Compound as described in U.S. Pat. No. 4,477,562

-continued

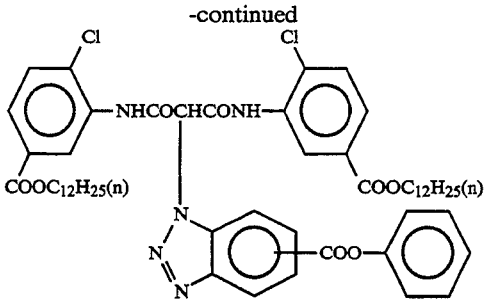

Comparative Coupler (B)

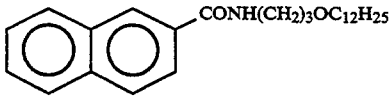

Comparative Coupler (C)

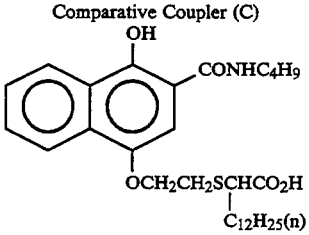

TABLE 6

| Sample No. | Red-Sensitive Emulsion Layer: Third Layer | Fourth Layer | Fifth Layer | Green-Sensitive Emulsion Layer: Tenth Layer |
|---|---|---|---|---|
| 401 | C-10 | C-4<br>C-10 | C-10 | C-10<br>Comparative Coupler (a) |
| 402 | " | " | " | C-10<br>Coupler (b) |
| 403 | " | " | " | C-10<br>Y-32 |
| 404 | " | " | " | C-10<br>Y-32 |
| 405 | C-3/C-4 = 1/1<br>(molar ratio) | C-4/C-9 = 2/1 | " | C-10<br>Y-31 |
| 406 | C-2 | C-5/C-7 = 1/1<br>C-10 | " | C-10<br>Y-33 |
| 407 | C-3 | C-3<br>C-10 | " | C-10<br>Coupler (d) |
| 408 | Comparative ccoupler (B) | Comparative Coupler (B)<br>Comparative Coupler (C) | Comparative Coupler (C) | Comparative Coupler (C)<br>Y-32 |

| No. | Blue-Sensitive Emulsion Layer: Thirteenth Layer | Fourteenth Layer | Sixteenth Layer | Remarks |
|---|---|---|---|---|
| 401 | Comparative Coupler (A)<br>Comparative Coupler (a) | Comparative Coupler (A)<br>Comparative Coupler (a) | Comparative Coupler (A)<br>Comparative Coupler (a) | Comparative Example |
| 402 | Comparative Coupler (A)<br>Coupler (b) | Comparative Coupler (A)<br>Coupler (b) | Comparative Coupler (A)<br>Coupler (b) | Present Invention |
| 403 | Comparative coupler (A)<br>Coupler (c) | Comparative Coupler (A)<br>Coupler (c) | Comparative Coupler (A)<br>Coupler (c) | Present Invention |
| 404 | Y-5<br>Y-32 | Y-5<br>Y-32 | Y-5<br>Y-32 | " |
| 405 | Y-22<br>Y-26 | Y-3<br>Y-30 | Y-7<br>Y-33 | " |
| 406 | Y-4/Y-19 = 2/1<br>Y-29 | Y-18/Y-10 = 1/1<br>Y-27 | Y-6/Y-13 = 1/1<br>Y-31 | " |
| 407 | Y-5<br>Coupler (d) | Y-5<br>Coupler (d) | Y-5<br>Coupler (d) | " |
| 408 | " | " | " | " |

The upper and lower amounts in each sample column correspond to the upper and lower amount in the column of Sample 401.

Samples 401 to 408 thus prepared were gradationwise exposed to light through a three color (B-G-R) separation filter, and then subjected to the color development as described below.

The density of the samples thus processed measured to obtain characteristic curves. From these characteristic curves, the logarithm of the reciprocal of the exposure which gave a density of (minimum density +0.2) was determined. The sensitivity of the various samples was determined by subtracting this value from that of Sample 401 as a countrol (ΔS).

For evaluation dye fastness, these samples were stored under the same conditions as used in Example 1 (60° C., 70% RH, 2 months), and then evaluated in the same manner as in Example 1.

The color stain and sharpness of the yellow image of these samples were also examined. For the evaluation of sharpness, these samples were exposed to white light through an MTF pattern, subjected to processing procedure as mentioned later, and then the MTF value (40 cycle/mm) measured in a counventional manner. The results were then compared.

The color development processing procedure used and the composition of the processing solution used are described below. This processing method is hereinafter referred to as "Processing Method J".

These samples were each slit into 35-mm wide strips. These samples were then exposed for picture taking. These samples were subjected to the following processing procedure at a rate of 1 $m^2$ a day for 15 days, and then the above mentioned properties were examined.

In the following processing procedure, an automatic developing machine Type FP-560B available from Fuji Photo Film Co., Ltd. was employed.

The processing steps and the composition of the processing solutions are given below.

| Processing Procedure | | | | |
|---|---|---|---|---|
| Step | Processing Time | Processing Temperature | Replenishment Rate* | Tank Capacity |
| Color development | 3 min. 5 sec. | 38.0° C. | 600 ml | 17 l |
| Bleach | 50 sec. | 38.0° C. | 140 ml | 5 l |
| Blix | 50 sec. | 38.0° C. | — | 5 l |
| Fixing | 50 sec. | 38.0° C. | 420 ml | 5 l |
| Rinse | 30 sec. | 38.0° C. | 980 ml | 3.5 l |
| Stabilization (1) | 20 sec. | 38.0° C. | — | 3 l |
| Stabilization (2) | 20 sec. | 38.0° C. | 560 ml | 3 l |
| Drying | 1 min. 30 sec. | 60° C. | | |

*per m of 35-mm wide light-sensitive material

The stabilization step was effected using a counterflow system wherein the solution flowed backward from the tank (2) to the tank (1). The overflow from the rinse bath was all introduced into the fixing bath. For replenishment of the blix bath, a noch was provided on the upper portion of the bleach bath and the fixing bath in the automatic developing machine so that all the overflow solution produced by the replenishment of the bleach bath and the fixing bath was introduced into the blix bath. The amount of the developer carried over to the bleach step, the amount of the bleaching solution brought over to the blix step, and the amount of the blix solution brought over to the rinse step were 65 ml, 50 ml, 50 ml and 50 ml per m of 35-mm wide light-sensitive material. The crossover time was 6 seconds at any step. This crossover time was included in the preprocessing time.

| | Running Solution (g) | Replenisher (g) |
|---|---|---|
| Color Developer | | |
| Diethylenetriaminepentaacetic acid | 2.0 | 2.0 |
| 1-Hydroxyethylidene-1,1-diphosphonic acid | 3.3 | 3.3 |
| Sodium sulfite | 3.9 | 5.1 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-(β-hydroxyethyl)amino]aniline sulfate | 4.5 | 6.1 |
| Water to make | 1.0 l | 1.0 l |
| pH | 10.05 | 10.15 |
| Bleaching Solution | | |
| Ferric ammonium 1,3-diaminopropanetetraacetate monohydrate | 130 | 195 |
| Ammonium bromide | 70 | 105 |
| Ammonium nitrate | 14 | 21 |
| Hydroxyacetic acid | 50 | 75 |
| Acetic acid | 40 | 60 |
| Water to make | 1.0 l | 1.0 l |
| pH (adjusted with aqueous ammonia) | 4.4 | 4.4 |

Blix Solution

15:85 (volume ratio) mixture of the above mentioned bleaching solution (running solution) and the following fixing solution (running solution) (pH 7.0)

| Fixing Solution | Running Solution (g) | Replenisher (g) |
|---|---|---|
| Ammonium sulfite | 19 | 57 |
| Aqueous solution of ammonium thiosulfate (700 g/l) | 280 ml | 840 ml |
| Imidazole | 15 | 45 |
| Ethylenediaminetetraacetic acid | 15 | 45 |
| Water to make | 1.0 l | 1.0 l |
| pH (adjusted with aqueous ammonia and acetic acid) | 7.4 | 7.45 |

Rinsing Solution

Tap water was passed through a mixed bed column filled with an H type strongly acidic cation exchange resin (Amberlite IR-120B produced by Rohm & Haas) and an OH type anion exchange resin (Amberlite IR-400) so that the calcium and magnesium ion concentrations were each reduced to 3 mg/l or less. To the solution were then added 20 mg/l of dichlorinated sodium isocyanurate and 150 mg/l of sodium sulfate. The pH of the solution was from 6.5 to 7.5.

| Stabilizing Solution (same for both running solution and replenisher) | |
|---|---|
| Sodium p-toluenesulfonate | 0.03 |
| Polyoxyethylene-p-monononylphenylether (average polymerization degree: 10) | 0.2 |
| Disodium ethylenediaminetetraacetate | 0.05 |
| 1,2,4-Triazole | 1.3 |
| 1,4-Bis(1,2,4-triazole-1-ilmethyl)-piperazine | 0.75 |
| Water to make | 1.0 l |

-continued

| Stabilizing Solution (same for both running solution and replenisher) | |
|---|---|
| pH | 8.5 |

Another batch of Samples 401 to 408 was subjected to the same test as above, except that 2-methyl-4-[N-ethyl-N-(β-hydroxyethyl)amino]aniline sulfate present in the color developer as a color developing agent was replaced by Developing Agent D-12 of the present invention in equimolecular amount. This processing method is hereinafter referred to as "Processing Method K". The color development time was altered to 2 minutes and 30 seconds by changing the sample carrier portion in the automatic developing machine.

The results obtained are set forth in Table 7 below.

TABLE 7

| Processing Method | Sample No. | Photographic Properties (sensitivity, ΔS) Cyan | Yellow | Colored Image Fastness (60° C., 70% RH) Cyan | Yellow | Image Quality Color Stain | Sharpness (40 cycle/mm) | Remarks |
|---|---|---|---|---|---|---|---|---|
| J (Comparative Process) | 401 | 0.00 (reference) | 0.00 (reference) | 95 | 72 | 0.12 | 0.39 | Comparative example |
| | 402 | 0.0 0 | +0.02 | 95 | 75 | 0.12 | 0.41 | " |
| | 403 | 0.00 | −0.02 | 95 | 70 | 0.12 | 0.40 | " |
| | 404 | 0.00 | +0.04 | 95 | 96 | 0.06 | 0.42 | " |
| | 405 | 0.00 | +0.05 | 95 | 96 | 0.06 | 0.42 | " |
| | 406 | 0.00 | +0.05 | 95 | 95 | 0.06 | 0.42 | " |
| | 407 | 0.00 | +0.04 | 95 | 96 | 0.06 | 0.41 | " |
| | 408 | −0.03 | +0.04 | 90 | 96 | 0.06 | 0.41 | " |
| K (using D-12 of the present invention) | 401 | +0.03 | +0.02 | 97 | 73 | 0.11 | 0.40 | " |
| | 402 | +0.03 | +0.06 | 97 | 78 | 0.10 | 0.43 | Present invention |
| | 403 | +0.03 | +0.02 | 97 | 73 | 0.10 | 0.42 | " |
| | 404 | +0.03 | +0.09 | 97 | 99 | 0.01 | 0.46 | " |
| | 405 | +0.03 | +0.10 | 97 | 99 | 0.01 | 0.46 | " |
| | 406 | +0.03 | +0.10 | 97 | 98 | 0.01 | 0.46 | " |
| | 407 | +0.03 | +0.09 | 97 | 99 | 0.02 | 0.44 | " |
| | 408 | −0.02 | +0.09 | 92 | 99 | 0.02 | 0.44 | " |

The results in Table 7 above show that the processing of a light-sensitive material comprising a coupler as used in the present invention represented by the general formula <1) or (2) with a color developer comprising the present color developing agent D-12 represented by the general formula (D) provides sufficient color development and excellent colored image fastness even when the color development time is reduced from 3 minutes and 15 seconds to 2 minutes and 30 seconds. More over, it is obvious from a comparison of Samples 402 to 408 between Processing Methods J and K that it still gives an excellent image quality such as color stain and sharpness. This shows that Samples 402 to 408 of the present invention exhibit a greater effect of improvement from Processing Method J to Processing Method K than Comparative Sample 401 and thus are preferred. It can be also seen in a comparison of Sample 404 and Sample 407 that the coupler of the present invention represented by the general formula (2) is preferably used in the form of coupler which releases a development-inhibiting compound (DIR coupler).

EXAMPLE 5

Sample 501 was prepared in the same manner as Sample 101 as described in Example 1 of JP-A-2-854.

Sample 502 was then prepared in the same manner as Sample 501, except that Coupler C-5 incorporated in the Twelfth Layer and the Thirteenth Layer were replaced by Coupler C- 22 and C-7 of the present invention in an equimolecular amount, respectively.

Samples 501 and 502 thus prepared were processed in the same manner as described in Example 1 of the above cited JP-A-2-854. Another batch of these samples was processed in the same manner as mentioned above, except that the developing agent N-ethyl-N-(β-methanesulfonamideethyl)-3-methyl-4-aminoaniline sulfate incorporated in the color developer was replaced by the above described color developing agent D-12 of the present invention and the color development time was reduced to 3 minutes. Thus, the coloring properties of these samples were evaluated.

As a result, it was confirmed that even the processing of Sample 502, which comprises the above described yellow coupler used in the present invention, with a color developer containing the present color developing agent D-12 for a reduced color development time provides a high sensitivity and maximum ultimate density. It was further confirmed that the present processing method causes little color stain to occur in the yellow image and gives a saturation rise.

Further, the color developing agent D-12 was replaced by D-5, D-3, E-5, or E-21 in an equimolecular amount with similar excellent results.

As has been described above, a silver halide color photographic material comprising a silver halide emulsion having a silver iodide content of 2 mol % or more and containing a coupler of the present invention represented by the general formula (I), particularly the general formula (1) or (2), can be processed with a color developer containing a coupler of the present invention represented by the general formula (D) or (E) to obtain a high sensitivity and maximum ultimate density and provide improvements in colored image fastness, particularly image quality, even the color development time is reduced.

Thus, a process for the processing of a silver halide color photographic material can be provided which provides rapid development and excellent photographic properties, colored image fastness and image quality.

While the invention has been described in detail and with reference to specific embodiments thereof, it will be apparent to one skilled in the art that various changes and modifications can be made therein without departing from the spirit and scope thereof.

What is claimed is:

1. A method for the processing of a silver halide color photographic material, which comprises processing an image-wise exposed silver halide color photographic material comprising at least one silver halide emulsion layer and containing an N,N-substituted malondiamide coupler with a color developer containing an aromatic primary amine color developing agent represented by the following general formula (D) or (H):

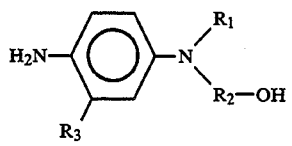

(D)

wherein $R_1$ represents a $C_{1-6}$ straight-chain or branched alkyl group or a $C_{3-6}$ straight-chain or branched hydroxyalkyl group; $R_2$ represents a $C_{3-6}$ straight-chain or branched alkylene group or a $C_{3-6}$ straight-chain or branched hydroxyalkylene group; and $R_3$ represents a hydrogen atom, a $C_{1-4}$ straight-chain or branched alkyl group or a $C_{1-4}$ straight-chain or branched alkoxy group;

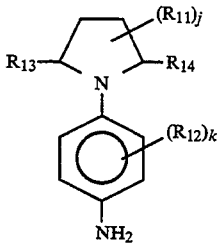

(H)

wherein $R_{11}$ represents a substituent; j represents 0 or an integer of 1 to 6, with the proviso that when j is 2 or more, the plurality of $(R_{11})$'s may be the same or different; and $R_{12}$ represents a substituent; k represents 0 or 1, and $R_{13}$ and $R_{14}$, which may be the same or different, each represents an alkyl group.

2. The method for processing of a silver halide color photographic material according to claim 1, containing a cyan coupler represented by the following general formula (C):

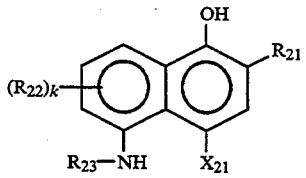

(C)

wherein $R_{21}$ represents $—CONR_{24}R_{25}$, $—SO_2NR_{24}R_{25}$, $—NHCOR_{24}$, $—NHCOOR_{26}$, $—NHSO_2R_{26}$, $—NHCONR_{24}R_{25}$ or $—NHSO_2NR_{24}R_{25}$ in which $R_{24}$ and $R_{25}$, which may be the same or different, each represents a hydrogen atom, an alkyl group, an aryl group or a heterocyclic group, and $R_{26}$ represents an alkyl group, aryl group or a heterocyclic group; $R_{22}$ represents a group capable of replacing a hydrogen atom on the naphthalene ring; k represents 0 or an integer of 1 to 3; and $R_{23}$ represents a substituent; and $X_{21}$ represents a hydrogen atom or a group capable of being released on coupling an oxidation product of an aromatic primary amine developing agent, with the proviso that when k is plural, the plurality of $(R_{22})$'s may be the same or different or may combine to form a ring, and that $R_{22}$ and $R_{23}$ or $R_{23}$ and $X_{21}$ may combine to form a ring.

3. The method for processing of a silver halide color photographic material according to claim 2, wherein the substituent represented by $R_{23}$ represents $—COR_{27}$, $—SO_2R_{28}$, $—CO_2R_{28}$, $—PO(OR_{28})_2$ or $—PO(R_{28})_2$ which $R_{27}$ has the same meaning as $R_{24}$ and $R_{28}$ has the same meaning as $R_{26}$.

4. The method for processing of a silver halide color photographic material according to claim 1, wherein the aromatic primary amine color developing agent is represented by formula (D).

5. The method for processing of a silver halide color photographic material according to claim 1, wherein the substituents represented by $R_{11}$ and $R_{12}$ each independently represent a halogen atom, an alkyl group, an aryl group, a heterocyclic group, a cyano group, a nitro group, a hydroxyl group, a carboxyl group, an alkoxy group, an aryloxy group, an acylamino group, an alkylamino group, an anilino group, a ureide group, a sulfamoylamino group, an alkylthio group, an arylthio group, an alkoxycarbonylamino group, a sulfonamide, group, a carbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imide group, a heterocyclic thio group, a sulfinyl group, a phosphonyl group, an aryloxycarbonyl group or an acyl group.

6. The method for processing of a silver halide color photographic material according to claim 1, wherein the color developer contains an aromatic primary amine color developing agent represented by formula (D).

7. The method for processing of a silver halide color photographic material according to claim 1, wherein the N,N-substituted malondiamide coupler is a coupler having the general formula (I)

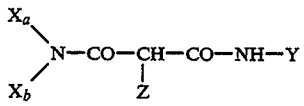

(I)

wherein $X_a$ and $X_b$ each independently represents a hydrogen atom, an alkyl group, an aryl group or a heterocyclic group, with the proviso that $X_a$ and $X_b$ may combine to form a nitrogen-containing heterocyclic ring with the >N— group to which they are attached; Y represents an aryl group or a heterocyclic group; and Z represents a group which is released from the coupler represented by the general formula (I), when it couplers with the oxidation product of a developing agent.

8. The method for processing of a silver halide color photographic material according to claim 7, wherein the N,N-substituted malondiamide yellow coupler represented by the general formula (I) is a coupler represented by the general formula (1) or (2):

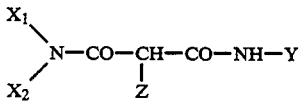

(1)

-continued (2)

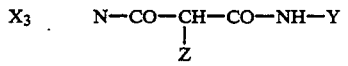

wherein $X_1$ and $X_2$ each represents an alkyl group, an aryl group or a heterocyclic group; $X_3$ represents an organic residue which forms a nitrogen-containing heterocyclic group with the >N— group; and Y and Z are as defined in the general formula (I).

9. The method for processing of a silver halide color photographic material according to claim 7, wherein the alkyl group represented by $X_a$ and $X_b$ is a $C_{1-30}$ saturated or unsaturated straight-chain, branched or cyclic substituted or unsubstituted alkyl group; the aryl group represented by $X_a$ and $X_b$ is a $C_{6-30}$ substituted or unsubstituted aryl group; the heterocyclic group represented by $X_a$ and $X_b$ is a $C_{1-20}$ 3- to 12-membered saturated or unsaturated, substituted or unsubstituted, monocyclic or condensed heterocyclic group containing at least one of a nitrogen atom, an oxygen atom and a sulfur atom as heteroatoms; the aryl group represented by Y is a $C_{6-30}$ substituted or unsubstituted aryl group; the heterocyclic group represented by Y is the same as defined for $X_a$ and $X_b$; and the group represented by Z may be any coupling-releasable group including a photographically inert group or a photographically useful group or a precursor thereof.

10. The method for processing of a silver halide color photographic material according to claim 8, wherein the coupler represented by the general formula (1) or (2) is a coupler represented by the general formulae (3), (4) or (5):

(3)

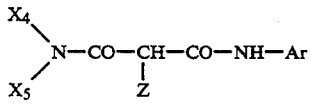

-continued (4)

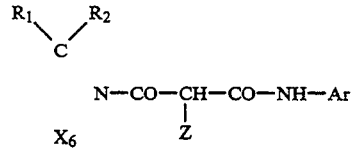

(5)

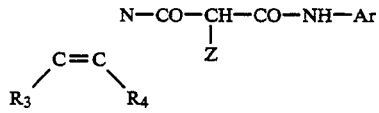

wherein Z is as defined in the general formula (1); $X_4$ represents an alkyl group; $X_5$ represents an alkyl group or an aryl group; Ar represents a phenyl group containing at least one substituent in the ortho-position; $X_6$ represents an organic residue which forms a monocyclic or condensed nitrogen-containing heterocyclic group with the $—C(R_1R_2)—N>$ group; $X_7$ represents an organic residue which forms a monocyclic or condensed nitrogen-containing heterocyclic group with the $C(R_3)=C(R_4)—N>$ group; and $R_1$, $R_2$, $R_3$ and $R_4$ each represents a hydrogen atom or a substituent.

11. The method for processing of a silver halide color photographic material according to claim 8, wherein the N,N-substituted malondiamide yellow coupler represented by general formula (I) is a coupler represented by general formula (2).

12. The method for processing of a silver halide color photographic material according to claim 10, wherein the coupler represented by general formula (1) or (2) is a coupler represented by the general formula (4) or (5).

13. The method for processing of a silver halide color photographic material according to claim 10, wherein the substituents represented by $R_1$ to $R_4$ each independently represent an alkyl group, an aryl group or a heterocyclic group.

* * * * *

UNITED STATES PATENT AND TRADEMARK OFFICE

CERTIFICATE OF CORRECTION

PATENT NO. : 5,380,625

DATED : January 10, 1995

INVENTOR(S) : KEIJI MIHAYASHI, MASATO TANIGUCHI, and NAOKI SAITO

It is certified that error appears in the above-identified patent and that said Letters Patent is hereby corrected as shown below:

Column 5, lines 46 to 48, formula (2), that portion of the formula reading

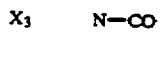

should read

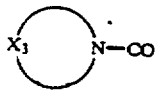

Column 10, lines 36 to 49, formula (4), that portion of the formula reading

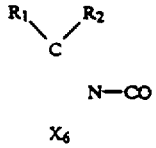

should read

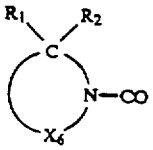

formula (5), that portion of the formula reading

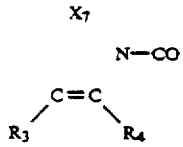

should read

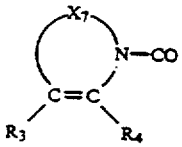

UNITED STATES PATENT AND TRADEMARK OFFICE

CERTIFICATE OF CORRECTION

PATENT NO. : 5,380,625

DATED : January 10, 1995

INVENTOR(S) : KEIJI MIHAYASHI, MASATO TANIGUCHI, and NAOKI SAITO

It is certified that error appears in the above-identified patent and that said Letters Patent is hereby corrected as shown below:

Column 73, Claim 8, formula (2), that portion of the formula reading

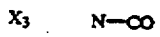

should read

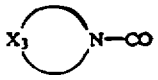

.

Column 74, Claim 10, formula (4), that portion of the formula reading

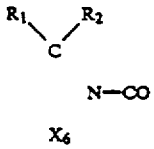

should read

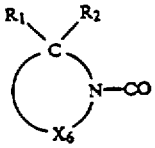

.

UNITED STATES PATENT AND TRADEMARK OFFICE

CERTIFICATE OF CORRECTION

PATENT NO. : 5,380,625

DATED : January 10, 1995

INVENTOR(S) : KEIJI MIHAYASHI, MASATO TANIGUCHI, and NAOKI SAITO

It is certified that error appears in the above-indentified patent and that said Letters Patent is hereby corrected as shown below:

formula (5), that portion of the formula reading

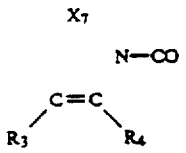

should read

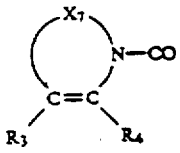

.

Signed and Sealed this

Twenty-third Day of May, 1995

*Attest:*

*Attesting Officer*

BRUCE LEHMAN

*Commissioner of Patents and Trademarks*